US011365465B2

(12) United States Patent
Yabu et al.

(10) Patent No.: US 11,365,465 B2
(45) Date of Patent: Jun. 21, 2022

(54) STEEL SHEET

(71) Applicant: NIPPON STEEL & SUMITOMO METAL CORPORATION, Tokyo (JP)

(72) Inventors: Shohei Yabu, Tokyo (JP); Akihiro Uenishi, Tokyo (JP); Koutarou Hayashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 394 days.

(21) Appl. No.: 16/098,015

(22) PCT Filed: Aug. 8, 2017

(86) PCT No.: PCT/JP2017/028750
§ 371 (c)(1),
(2) Date: Oct. 31, 2018

(87) PCT Pub. No.: WO2018/030400
PCT Pub. Date: Feb. 15, 2018

(65) Prior Publication Data

US 2019/0144966 A1 May 16, 2019

(30) Foreign Application Priority Data

Aug. 8, 2016 (WO) ..... PCT/JP2016/073271
Dec. 22, 2016 (JP) ..... JP2016-249407

(51) Int. Cl.

| | |
|---|---|
| ***C22C 38/06*** | (2006.01) |
| ***C22C 38/00*** | (2006.01) |
| ***C22C 38/58*** | (2006.01) |
| ***C21D 9/46*** | (2006.01) |
| ***C21D 6/00*** | (2006.01) |
| ***C21D 8/02*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |

(52) U.S. Cl.
CPC ..... *C22C 38/06* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 9/46* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/08* (2013.01); *C22C 38/12* (2013.01); *C22C 38/14* (2013.01); *C22C 38/16* (2013.01); *C22C 38/18* (2013.01); *C22C 38/58* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 9/46
See application file for complete search history.

(56) References Cited

U.S. PATENT DOCUMENTS

| | | | | |
|---|---|---|---|---|
| 6,537,394 | B1 | 3/2003 | Osawa et al. | |
| 6,866,725 | B2 * | 3/2005 | Fujita | C21D 8/10 148/320 |
| 8,491,732 | B2 * | 7/2013 | Daitoh | C21D 8/065 148/320 |
| 8,715,430 | B2 * | 5/2014 | Hara | C22C 38/02 148/307 |
| 2006/0137768 | A1 | 6/2006 | Yuse et al. | |
| 2011/0005643 | A1 | 1/2011 | Murakami et al. | |
| 2011/0008647 | A1 | 1/2011 | Azuma et al. | |
| 2011/0139315 | A1 * | 6/2011 | Nakagaito | C21D 8/0436 148/333 |
| 2013/0092295 | A1 * | 4/2013 | Yokoi | C22C 38/58 148/504 |
| 2013/0266821 | A1 | 10/2013 | Kawasaki et al. | |
| 2014/0000765 | A1 * | 1/2014 | Nozaki | B32B 15/013 148/504 |
| 2014/0182748 | A1 | 7/2014 | Nakagaito et al. | |

(Continued)

FOREIGN PATENT DOCUMENTS

| | | | |
|---|---|---|---|
| CN | 101932744 | A | 12/2010 |
| DE | 102014017273 | A1 | 5/2016 |

(Continued)

OTHER PUBLICATIONS

Extended European Search Report for corresponding European Application No. 17839470.6, dated Feb. 7, 2020.
International Search Report for PCT/JP2017/028750 dated Sep. 26, 2017.
Ramazani et al., "The effect of martensite banding on the mechanical properties and formability of TRIP steels", Material Science & Engineering A, 2016, vol. 651, pp. 160-164.
Written Opinion of the International Searching Authority for PCT/JP2017/028750 (PCT/ISA/237) dated Sep. 26, 2017.
Chinese Office Action dated Apr. 3, 2020, for Chinese Application No. 201780040099.X.

(Continued)

*Primary Examiner* — Alexandra M Moore
(74) *Attorney, Agent, or Firm* — Birch, Stewart, Kolasch & Birch, LLP

(57) ABSTRACT

A steel sheet includes a predetermined chemical composition, and includes a steel microstructure represented by, in an area ratio, ferrite: 5% to 80%, a hard microstructure constituted of bainite, martensite or retained austenite or an arbitrary combination of the above: 20% to 95%, and a standard deviation of a line fraction of the hard microstructure on a line in a plane perpendicular to a thickness direction: 0.050 or less in a depth range where a depth from a surface when a thickness of a steel sheet is set as t is from 3t/8 to t/2.

4 Claims, 1 Drawing Sheet

(56) References Cited

U.S. PATENT DOCUMENTS

| | | | |
|---|---|---|---|
| 2015/0034215 | A1 | 2/2015 | Schulz et al. |
| 2015/0059935 | A1 | 3/2015 | Hebesberger et al. |
| 2015/0337408 | A1 | 11/2015 | Schulz et al. |
| 2015/0361519 | A1 | 12/2015 | Zhu et al. |
| 2016/0017465 | A1 | 1/2016 | Toda et al. |
| 2018/0347018 | A1 | 12/2018 | Schulz et al. |

FOREIGN PATENT DOCUMENTS

| | | | |
|---|---|---|---|
| EP | 2256224 | A1 | 12/2010 |
| EP | 2258886 | A1 | 12/2010 |
| EP | 2 371 978 | A1 | 10/2011 |
| EP | 2604715 | A1 | 6/2013 |
| JP | 56-6704 | A | 1/1981 |
| JP | 62-6745 | A | 1/1987 |
| JP | 2002-66601 | A | 3/2002 |
| JP | 2002-88447 | A | 3/2002 |
| JP | 2002-105537 | A | 4/2002 |
| JP | 2006-207016 | A | 8/2006 |
| JP | 2009-13488 | A | 1/2009 |
| JP | 2009-203548 | A | 9/2009 |
| JP | 2009-249669 | A | 10/2009 |
| JP | 2009-256773 | A | 11/2009 |
| JP | 2010-65307 | A | 3/2010 |
| JP | 2010-121175 | A | 6/2010 |
| JP | 2010-196115 | A | 9/2010 |
| JP | 2011-99149 | A | 5/2011 |
| JP | 2012-36497 | A | 2/2012 |
| JP | 2013-241636 | A | 12/2013 |
| JP | 2014-34716 | A | 2/2014 |
| JP | 2016-510361 | A | 4/2016 |
| JP | 2017-88944 | A | 5/2017 |
| TW | I417400 | B | 12/2013 |
| WO | WO 2009/119751 | A1 | 10/2009 |
| WO | WO 2014/171427 | A1 | 10/2014 |

OTHER PUBLICATIONS

International Preliminary Report on Patentability and English translation of the Written Opinion of the International Searching Authority (Forms PCT/IB/338, PCT/IB/373 and PCT/ISA/237) for International Application No. PCT/2017/028750, dated Feb. 21, 2019.

* cited by examiner

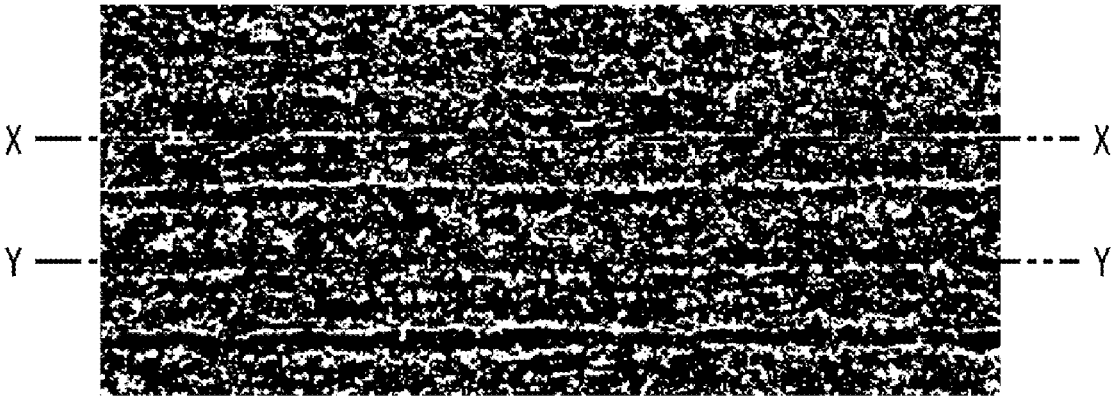
X
X
Y
Y

STEEL SHEET

TECHNICAL FIELD

The present invention relates to a high-strength steel sheet suitable for machine structural parts and the like including body structural parts of an automobile.

BACKGROUND ART

In order to suppress an emission amount of carbon dioxide gas from an automobile, a reduction in weight of a vehicle body of an automobile using a high-strength steel sheet has been put forward. Further, in order also to secure safety of a passenger, the high-strength steel sheet has come to be often used for the vehicle body. In order to put a further reduction in weight of the vehicle body forward, a further improvement in strength is important. On the other hand, some parts of the vehicle body require excellent formability. For example, excellent elongation and hole expandability are required of a high-strength steel sheet for framework system parts. In particular, not only good ductility but also excellent hole expandability are required of a high-strength steel sheet to be used for a member (sub-frame) and reinforcements (reinforcing members) which are framework members of an automobile.

However, it is difficult that the improvement in strength and an improvement in formability are compatible with each other. Techniques which aim at the compatibility of the improvement in strength and the improvement in formability have been proposed, but these do not make it possible to obtain sufficient characteristics either. Further, in recent years, a further improvement in strength is required, and techniques which aim at compatibility with the improvement in formability have been proposed, but the improvement in formability, in particular, hole expandability is difficult. On the other hand, with an improvement in productivity of a steel sheet, excellent hole expandability under the condition that a testing rate in a quality inspection of the steel sheet is improved is desired, but in a conventional steel sheet, the improvement in hole expandability when a machining speed is fast is difficult.

CITATION LIST

Patent Literature

Patent Literature 1: Japanese Laid-open Patent Publication No. 2009-13488

Patent Literature 2: Japanese Laid-open Patent Publication No. 2012-36497

Patent Literature 3: Japanese Laid-open Patent Publication No. 2002-88447

Patent Literature 4: Japanese Laid-open Patent Publication No. 2009-249669

Patent Literature 5: Japanese Laid-open Patent Publication No. 2010-65307

Patent Literature 6: Japanese Laid-open Patent Publication No. 2002-66601

Patent Literature 7: Japanese Laid-open Patent Publication No. 2014-34716

Patent Literature 8: International Publication Pamphlet No. WO 2014/171427

Patent Literature 9: Japanese Laid-open Patent Publication No. 56-6704

Patent Literature 10: Japanese Laid-open Patent Publication No. 2006-207016

Patent Literature 11: Japanese Laid-open Patent Publication No. 2009-256773

Patent Literature 12: Japanese Laid-open Patent Publication No. 2010-121175

SUMMARY OF INVENTION

Technical Problem

An object of the present invention is to provide a steel sheet which allows excellent strength and formability to be obtained and, in particular, is also excellent in formability at a time of high-speed machining.

Solution to Problem

The present inventors have conducted keen studies in order to solve the above-described problems. As a result of this, it has become clear that in a conventional steel sheet, a band-shaped structure in which hard microstructures each constituted of bainite, martensite or retained austenite or an arbitrary combination of these lie in a row in a band shape exists, and the band-shaped structure becomes a stress concentration point, thereby promoting generation of a void. Martensite includes fresh martensite and tempered martensite. Moreover, it has also become clear that due to close existence of the generation points of the void caused by the band-shaped structure, connection of the voids is promoted. That is, it has become clear that the band-shaped structure affects hole expandability. Then, the present inventors have found that for the improvement in hole expandability, it is important to suppress the band-shaped structure. Furthermore, the present inventors have also found that suppressing the band-shaped structure improves a surface property at a time of molding.

The band-shaped structure is formed by segregation of alloying elements such as Mn in a smelting step and by, in hot rolling and cold rolling, extension in a rolling direction of an area where the alloying elements have been segregated. Accordingly, for the suppression of the band-shaped structure, it is important to suppress the segregation of the alloying elements. In addition, the present inventors have found that for the suppression of the band-shaped structure, before finish rolling, it is very effective to cause recrystallization of austenite by introducing a lattice defect under high temperatures and to increase a Si concentration in an alloy segregation portion. That is, the recrystallization promotes diffusion of the alloying elements along grain boundaries of recrystallized austenite grains, resulting in distributing the alloying elements in a mesh shape, thereby suppressing the segregation of the alloying elements. Moreover, the present inventors have found that the Si concentration of a Mn segregation portion is increased by containing Si, thereby forming ferrite more homogeneously at a time of cooling, resulting in effectively eliminating a band structure. Such a method makes it possible to effectively eliminate the band structure without conventional prolonged heating and addition of expensive alloying elements.

The hole expandability is evaluated by a method defined by JIS T 1001, JIS Z 2256, or JFS T 1001. In general, a testing rate of a hole expansion test is set to 0.2 mm/sec. However, the present inventors have found that test results obtained by the testing rate are different from each other and the results obtained by the test using the testing rate of about 0.2 mm/sec fail to sufficiently reflect the hole expandability at a time of high-speed machining. This is considered because a strain rate also increases with an increase in a machining speed. Accordingly, for the evaluation of the hole expandability at a time of the high-speed machining, it can be said that results obtained by a hole expansion test in which a testing rate is set to about 1 mm/sec being a defined upper limit value are important. Consequently, the present inventors have also found that the steel sheet in which the band structure has been eliminated as described above has good results obtained by the hole expansion test using the testing rate of 1 mm/sec.

The inventors of the present application have further conducted keen studies based on such observation, and consequently have conceived embodiments of the invention described below.

(1)

A steel sheet includes:

a chemical composition represented by, in mass %,

C: 0.05% to 0.40%,

Si: 0.05% to 6.00%,

Mn: 1.50% to 10.00%,

Acid-soluble Al: 0.01% to 1.00%,

P: 0.10% or less,

S: 0.01% or less,

N: 0.01% or less,

Ti: 0.0% to 0.2%,

Nb: 0.0% to 0.2%,

V: 0.0% to 0.2%,

Cr: 0.0% to 1.0%,

Mo: 0.0% to 1.0%,

Cu: 0.0% to 1.0%,

Ni: 0.0% to 1.0%,

Ca: 0.00% to 0.01%,

Mg: 0.00% to 0.01%,

REM: 0.00% to 0.01%,

Zr: 0.00% to 0.01%, and the balance: Fe and impurities, and includes a steel microstructure represented by, in an area ratio, ferrite: 5% to 80%, a hard microstructure constituted of bainite, martensite or retained austenite or an arbitrary combination of the above: 20% to 95%, and a standard deviation of a line fraction of the hard microstructure on a line in a plane perpendicular to a thickness direction: 0.050 or less in a depth range where a depth from a surface when a thickness of a steel sheet is set as t is from 3t/8 to t/2.

(2)

The steel sheet according to (1), wherein in the steel microstructure, in an area ratio, the retained austenite: 5.0% or more, is established.

(3)

The steel sheet according to (1) or (2), wherein in the chemical composition, in mass %, Ti: 0.003% to 0.2%, Nb: 0.003% to 0.2%, or V: 0.003% to 0.2%, or an arbitrary combination of the above is established.

(4)

The steel sheet according to any one of (1) to (3), wherein in the chemical composition, in mass %, Cr: 0.005% to 1.0%, Mo: 0.005% to 1.0%, Cu: 0.005% to 1.0%, or Ni: 0.005% to 1.0%, or an arbitrary combination of the above is established.

(5)

The steel sheet according to any one of (1) to (4), wherein in the chemical composition, in mass %, Ca: 0.0003% to 0.01%, Mg: 0.0003% to 0.01%, REM: 0.0003% to 0.01%, or Zr: 0.0003% to 0.01%, or an arbitrary combination of the above is established.

Advantageous Effects of Invention

According to the present invention, an appropriate steel microstructure makes it possible to obtain excellent strength and formability and also to obtain excellent formability at a time of high-speed machining. Further, according to the present invention, suppressing a band-shaped structure makes it possible to suppress a banded surface defect which occurs at a time of molding of an ultra-high strength steel and to obtain an excellent appearance.

BRIEF DESCRIPTION OF DRAWING

FIG. 1 is a view illustrating a method of finding a line fraction of a hard microstructure.

DESCRIPTION OF EMBODIMENTS

Hereinafter, an embodiment of the present invention will be explained.

First, a chemical composition of a slab to be used for a steel sheet according to the embodiment of the present invention and manufacture thereof will be explained. As described later, the steel sheet according to the embodiment of the present invention is manufactured through multi-axial compression forming, hot rolling, cold rolling, annealing, and so on of the slab. Accordingly, the chemical composition of the steel sheet and the slab is in consideration of not only a property of the steel sheet but also these processes. In the following explanation, "%" which is a unit of a content of each element contained in the steel sheet and the slab means "mass %" unless otherwise stated. The steel sheet according to this embodiment has a chemical composition represented by, in mass %, C: 0.05% to 0.40%, Si: 0.05% to 6.00%, Mn: 1.50% to 10.00%, acid-soluble Al: 0.01% to 1.00%, P: 0.10% or less, S: 0.01% or less, N: 0.01% or less, Ti: 0.0% to 0.2%, Nb: 0.0% to 0.2%, V: 0.0% to 0.2%, Cr: 0.0% to 1.0%, Mo: 0.0% to 1.0%, Cu: 0.0% to 1.0%, Ni: 0.0% to 1.0%, Ca: 0.00% to 0.01%, Mg: 0.00% to 0.01%, REM (rear earth metal): 0.00% to 0.01%, Zr: 0.00% to 0.01%, and the balance: Fe and impurities. As the impurities, the ones contained in raw materials such as ore and scrap and the ones contained in a manufacturing process are exemplified.

(C: 0.05% to 0.40%)

C contributes to an improvement in tensile strength. When the C content is less than 0.05%, sufficient tensile strength, for example, a tensile strength of 780 MPa or more is not obtained. Accordingly, the C content is set to 0.05% or more and preferably set to 0.07% or more. On the other hand, when the C content is more than 0.40%, martensite becomes hard and weldability deteriorates. Accordingly, the C content is set to 0.40% or less, preferably set to 0.35% or less, more preferably set to 0.30% or less, and further preferably set to 0.20% or less.

(Si: 0.05% to 6.00%)

Si increases tensile strength without a deterioration of hole expandability by solid-solution strengthening. When the Si content is less than 0.05%, sufficient tensile strength, for example, a tensile strength of 780 MPa or more is not obtained. Accordingly, the Si content is set to 0.05% or more, preferably set to 0.20% or more, and more preferably set to 0.50% or more. Si also has an action in which it is concentrated in a Mn segregation portion, promotes generation of ferrite, and suppresses a band-shaped distribution of a hard microstructure. This action is particularly remarkable when the Si content is 2.00% or more. Accordingly, the Si content is preferably set to 2.00% or more and more preferably set to 2.50% or more. On the other hand, when the Si content is more than 6.00%, a ferrite phase-stabilizing effect of an alloy segregation portion exceeds an austenite phase-stabilizing effect of Mn, and formation of a band-shaped structure is promoted. Accordingly, the Si content is set to 6.00% or less and preferably set to 5.00% or less. Further, containing Si according to the Mn content allows more effective suppression of the band-shaped distribution. From this viewpoint, the Si content is preferably set to 1.0 times or more and 1.3 times or less the Mn content. From the viewpoint of a surface property of the steel sheet, the Si content may be set to 2.00% or less, may be set to 1.50% or less, or may be set to 1.20% or less.

(Mn: 1.50% to 10.00%)

Mn contributes to an improvement in tensile strength. When the Mn content is less than 1.50%, sufficient tensile strength, for example, a tensile strength of 780 MPa or more is not obtained. Accordingly, the Mn content is set to 1.50% or more. Mn can increase a retained austenite fraction without adding expensive alloying elements. From this viewpoint, the Mn content is preferably set to 1.70% or more and more preferably set to 2.00% or more. On the other hand, when the Mn content is more than 10.00%, a precipitation amount of MnS increases, and low-temperature toughness deteriorates. Accordingly, the Mn content is set to 10.00% or less. From the viewpoint of productivity in the hot rolling and the cold rolling, the Mn content is preferably set to 4.00% or less and more preferably set to 3.00% or less.

(Acid-Soluble Al: 0.01% to 1.00%)

Acid-soluble Al has an action which makes the steel sheet sound by deacidifying steel. When the acid-soluble Al content is less than 0.01%, an effect by this action is not sufficiently obtained. Accordingly, the acid-soluble Al content is set to 0.01% or more and preferably set to 0.02% or more. On the other hand, when the acid-soluble Al content is more than 1.00%, weldability decreases, or an increase in an oxide-based inclusion leads to a deterioration of the surface property. Accordingly, the acid-soluble Al content is set to 1.00% or less and preferably set to 0.80% or less. Note that acid-soluble Al is not a compound such as $Al_2O_3$ insoluble in acid but is soluble in acid.

(P: 0.10% or Less)

P is not an essential element but, for example, is contained as an impurity in steel. From the viewpoint of weldability, the P content as low as possible is preferable. In particular, when the P content is more than 0.10%, a decrease in weldability is remarkable. Accordingly, the P content is set to 0.10% or less and preferably set to 0.03% or less. A reduction of the P content requires costs, and in an attempt to reduce it to less than 0.0001%, the costs remarkably increase. Therefore, the P content may be set to 0.0001% or more. Because P contributes to an improvement in strength, the P content may be set to 0.01% or more.

(S: 0.01% or Less)

S is not an essential element but, for example, is contained as an impurity in steel. From the viewpoint of weldability, the S content as low as possible is preferable. The higher the S content is, the more the precipitation amount of MnS increases, resulting in a decrease in low-temperature toughness. In particular, when the S content is more than 0.01%, a decrease in weldability and the decrease in low-temperature toughness are remarkable. Accordingly, the S content is set to 0.01% or less, preferably set to 0.003% or less, and more preferably set to 0.0015% or less. A reduction of the S content requires costs, and in an attempt to reduce it to less than 0.001%, the costs remarkably increase, and in an attempt to reduce it to less than 0.0001%, the costs further remarkably increase. Therefore, the S content may be set to 0.0001% or more, and may be set to 0.001% or more.

(N: 0.01% or Less)

N is not an essential element but, for example, is contained as an impurity in steel. From the viewpoint of weldability, the N content as low as possible is preferable. In particular, when the N content is more than 0.01%, a decrease in weldability is remarkable. Accordingly, the N content is set to 0.01% or less and preferably set to 0.006% or less. A reduction of the N content requires costs, and in an attempt to reduce it to less than 0.0001%, the costs remarkably increase. Therefore, the N content may be set to 0.0001% or more.

Ti, Nb, V, Cr, Mo, Cu, Ni, Ca, Mg, REM and Zr are not essential elements but optional elements which may be appropriately contained in the steel sheet and the steel within limits of predetermined amounts.

(Ti: 0.0% to 0.2%, Nb: 0.0% to 0.2%, V: 0.0% to 0.2%)

Ti, Nb and V contribute to an improvement in strength. Accordingly, Ti, Nb or V or an arbitrary combination of these may be contained. In order to obtain this effect sufficiently, the Ti content, the Nb content or the V content or an arbitrary combination of these is preferably set to 0.003% or more. On the other hand, when the Ti content, the Nb content or the V content or an arbitrary combination of these is more than 0.2%, the hot rolling and the cold rolling become difficult. Accordingly, the Ti content, the Nb content or the V content or an arbitrary combination of these is set to 0.2% or less. That is, Ti: 0.003% to 0.2%, Nb: 0.003% to 0.2%, or V: 0.003% to 0.2%, or an arbitrary combination of these is preferably satisfied.

(Cr: 0.0% to 1.0%, Mo: 0.0% to 1.0%, Cu: 0.0% to 1.0%, Ni: 0.0% to 1.0%)

Cr, Mo, Cu and Ni contribute to an improvement in strength. Accordingly, Cr, Mo, Cu, or Ni or an arbitrary combination of these may be contained. In order to obtain this effect sufficiently, the Cr content, the Mo content, the Cu content or the Ni content or an arbitrary combination of these is preferably set to 0.005% or more. On the other hand, when the Cr content, the Mo content, the Cu content or the Ni content or an arbitrary combination of these is more than 1.0%, saturating an effect by the above-described action makes costs wastefully high. Accordingly, the Cr content, the Mo content, the Cu content or the Ni content or an arbitrary combination of these is set to 1.0% or less. That is, Cr: 0.005% to 1.0%, Mo: 0.005% to 1.0%, Cu: 0.005% to 1.0%, or Ni: 0.005% to 1.0%, or an arbitrary combination of these is preferably satisfied.

(Ca: 0.00% to 0.01%, Mg: 0.00% to 0.01%, REM: 0.00% to 0.01%, Zr: 0.00% to 0.01%)

Ca, Mg, REM and Zr contribute to inclusions being finely dispersed and enhance toughness. Accordingly, Ca, Mg, REM or Zr or an arbitrary combination of these may be contained. In order to obtain this effect sufficiently, the Ca content, the Mg content, the REM content or the Zr content or an arbitrary combination of these is preferably set to 0.0003% or more. On the other hand, when the Ca content, the Mg content, the REM content or the Zr content or an arbitrary combination of these is more than 0.01%, the surface property deteriorates. Accordingly, the Ca content, the Mg content, the REM content or the Zr content or an arbitrary combination of these is set to 0.01% or less. That is, Ca: 0.0003% to 0.01%, Mg: 0.0003% to 0.01%, REM: 0.0003% to 0.01%, or Zr: 0.0003% to 0.01%, or an arbitrary combination of these is preferably satisfied.

REM (rare earth metal) indicates total 17 types of elements of Sc, Y and lanthanoids, and "REM content" means a total content of these 17 types of elements. The lanthanoids are industrially added, for example, in a form of misch metal.

Next, a steel microstructure of the steel sheet according to the embodiment of the present invention will be explained. The steel sheet according to this embodiment has a steel microstructure represented by, in an area ratio, ferrite: 5% to 80%, a hard microstructure constituted of bainite, martensite or retained austenite or an arbitrary combination of these: 20% to 95%, and a standard deviation of a line fraction of the hard microstructure on a line in a plane perpendicular to a thickness direction: 0.050 or less in a depth range where a depth from a surface when a thickness of a steel sheet is set as t is from 3t/8 to t/2. Martensite includes fresh martensite and tempered martensite.

(Ferrite: 5% to 80%)

When an area ratio of ferrite is less than 5%, it is difficult to secure a fracture elongation (EL) of 10% or more. Accordingly, the area ratio of ferrite is set to 5% or more, preferably set to 10% or more, and more preferably set to 20% or more. On the other hand, when the area ratio of ferrite is more than 80%, sufficient tensile strength, for example, a tensile strength of 780 MPa or more is not obtained. Accordingly, the area ratio of ferrite is set to 80% or less and preferably set to 70% or less.

(Hard Microstructure: 20% to 95%)

when an area ratio of a hard microstructure is less than 20%, sufficient tensile strength, for example, a tensile strength of 780 MPa or more is not obtained. Accordingly, the area ratio of a hard microstructure is set to 20% or more and preferably set to 30% or more. On the other hand, when the area ratio of a hard microstructure is more than 95%, sufficient ductility is not obtained. Accordingly, the area ratio of a hard microstructure is set to 95% or less, preferably set to 90% or less, and more preferably set to 80% or less.

(Retained Austenite (Retained γ): 5.0% or More)

When an area ratio of retained austenite is 5.0% or more, a fracture elongation of 12% or more is easy to obtain. Accordingly, the area ratio of retained austenite is preferably set to 5.0% or more and more preferably set to 10.0% or more. An upper limit of the area ratio of retained austenite is not limited, but in the current technological level, it is not easy to manufacture a steel sheet in which the area ratio of retained austenite is more than 30.0%.

The area ratio of ferrite and the area ratio of a hard microstructure can be measured as follows. First, a sample is picked so that a cross section perpendicular to a width direction in a ¼ position of a width of a steel sheet is exposed, and this cross section is corroded by a Lepera etching solution. Next, an optical micrograph of an area where a depth from a surface of the steel sheet is from 3t/8 to t/2 is taken. At this time, for example, a magnification is set to 200 times. The corrosion using the Lepera etching solution allows an observation surface to be roughly divided into a black portion and a white portion. Then, the black portion has a possibility of including ferrite, bainite, carbide and pearlite. A portion including a lamellar-shaped structure in grains in the black portion corresponds to pearlite. A portion including no lamellar-shaped structure and including no substructure in grains in the black portion corresponds to ferrite. A spherical portion whose luminance is particularly low and whose diameter is about 1 μm to 5 μm in the black portion corresponds to carbide. A portion including a substructure in grains in the black portion corresponds to bainite. Accordingly, the area ratio of ferrite is obtained by measuring an area ratio of the portion including no lamellar-shaped structure and including no substructure in grains in the black portion, and an area ratio of bainite is obtained by measuring an area ratio of the portion including a substructure in grains in the black portion. Further, an area ratio of the white portion is a total area ratio of martensite and retained austenite. Accordingly, the area ratio of a hard microstructure is obtained from the area ratio of bainite and the total area ratio of martensite and retained austenite. From this optical micrograph, a circle-equivalent mean diameter r of a hard microstructure to be used for the below-described measurement of a standard deviation of a line fraction of the hard microstructure can be measured.

An area fraction of retained austenite can be specified by, for example, X-ray measurement. In this case, a volume fraction of retained austenite found by the X-ray measurement can be converted into the area fraction of retained austenite from the viewpoint of quantitative metallography. In this method, for example, a portion from a surface of a steel sheet to ¼ of a thickness of the steel sheet is removed by mechanical polishing and chemical polishing, and MoKα rays are used as characteristic X-rays. Then, from an integrated intensity ratio of diffraction peaks of (200) and (211) of a body-centered cubic lattice (bcc) phase and (200), (220) and (311) of a face-centered cubic lattice (fcc) phase, the area fraction of retained austenite is calculated by using the following formula.

$$S\gamma=(I_{200f}+I_{220f}+I_{311f})/(I_{200b}+I_{211b})\times 100$$

(Sγ indicates the area fraction of retained austenite, $I_{200f}$, $I_{220f}$, and $I_{311f}$ indicate intensities of diffraction peaks of (200), (220), and (311) of the fcc phase respectively, and $I_{200b}$ and $I_{211b}$ indicate intensities of diffraction peaks of (200) and (211) of the bcc phase respectively.)

(A standard deviation of a line fraction of a hard microstructure on a line in a plane perpendicular to a thickness direction: 0.050 or less in a depth range where a depth from a surface when a thickness of a steel sheet is set as t is from 3t/8 to t/2)

In processing of applying a locally large deformation such as hole expansion processing, a steel sheet reaches a fracture through necking or generation and connection of voids in a steel microstructure. In tensile deformation in a case where the steel sheet becomes constricted, a central portion of the steel sheet becomes a stress concentration point, and normally, the voids are generated mainly in a t/2 position from a surface of the steel sheet. Then, the voids connect with each other, and the voids become coarse to a size of t/8 or more, which causes a fracture with this coarse void being a starting point. A generation site of the void which becomes the starting point of the fracture as described above is a hard microstructure existing in a range where a depth from a surface is from 3t/8 to t/2. Accordingly, a distribution of the hard microstructure in the depth range where the depth from the surface is from 3t/8 to t/2 greatly affects hole expandability.

Then, a large standard deviation of a line fraction of a hard microstructure in the above-described depth range means that variations in a ratio of the hard microstructure in a thickness direction are large, namely that the steel microstructure becomes a band-shaped structure. In particular, when a standard deviation of a line fraction of the hard microstructure is more than 0.050, the band-shaped structure is remarkable, a density of the stress concentration point is locally high, and sufficient hole expandability is not obtained. Accordingly, a standard deviation of a line fraction of the hard microstructure is set to 0.050 or less and preferably set to 0.040 or less in a depth area where the depth from the surface is from 3t/8 to t/2.

Here, a method of measuring a standard deviation of a line fraction of a hard microstructure will be explained.

First, an optical micrograph taken similarly to the measurement of the area ratio is subjected to image processing and binarized into a black portion and a white portion. FIG. 1 illustrates one example of an image after the binarization. Next, over from a portion at a depth of 3t/8 to a portion at a depth of t/2 in the image of the observational object, a starting point of a line segment is set every r/30 (r is a circle-equivalent mean diameter of a hard microstructure). Because a depth range of the observational object is an area in a thickness of t/8 from 3t/8 to t/2, the number of starting points is 15t/4 r. Thereafter, a line segment extending in a direction perpendicular to a thickness direction from each of the starting points, for example, in a rolling direction and having a length of 50 r is set, and a line fraction of a hard microstructure on this line segment is measured. Then, a standard deviation of the line fractions among 15t/4 r line segments is calculated.

The circle-equivalent mean diameter r and the thickness t of the steel sheet are not limited. For example, the circle-equivalent mean diameter r is 5μ m to 15 μm, and the thickness t of the steel sheet is 1 mm to 2 mm (1000 μm to 2000 μm). An interval to set the starting points of the line segments is not limited and may be changed depending on a resolution and the number of pixels of a target image, measuring work time, and the like. For example, even though the interval is set to about r/10, a result equal to that in a case of setting it to r/30 is obtained.

A depth range where a depth from a surface is from 3t/8 to t/2 can be infinitely segmented theoretically, and a plane perpendicular to a thickness direction also infinitely exists. However, line fractions cannot be measured regarding all of these. On the other hand, according to the above-described measuring method, the above-described depth range is segmented at sufficiently fine intervals, and a result equal to that in a case where the depth range is infinitely segmented can be obtained. For example, in FIG. 1, on an X-X line, a line fraction of the hard microstructure is high, and on a Y-Y line, a line fraction of the hard microstructure is low.

According to this embodiment, for example, when a tensile strength of 780 MPa or more is obtained and measurement is performed with a hole expansion testing rate being 1 mm/sec in a method defined by JIS Z 2256, a hole expansion ratio (HER) of 30% or more is obtained. Further, when a JIS No. 5 tensile test piece is picked from the steel sheet so that a tensile direction becomes a direction orthogonal to a rolling direction, and is measured by a method defined by JIS Z 2241, a fracture elongation of 10% or more is obtained.

Next, a method of manufacturing the steel sheet according to the embodiment of the present invention will be explained. In the method of manufacturing the steel sheet according to the embodiment of the present invention, multi-axial compression forming, hot rolling, cold rolling, and annealing of the slab having the above-described chemical composition are performed in this order.

(Multi-Axial Compression Forming)

For example, molten steel having the above-described chemical composition is smelted by using a steel converter, an electric furnace, or the like, and a slab can be manufactured by a continuous casting method. In place of the continuous casting method, an ingot-making method, a thin slab casting method, or the like may be employed.

The slab is heated to 950° C. to 1300° C. before being provided for the multi-axial compression forming. A holding time after the heating is not limited, but is preferably set to 30 minutes or longer from the viewpoint of hole expandability, and is preferably set ten hours or shorter and more preferably set to five hours or shorter from the viewpoint of suppression of an excessive scale loss. When straightforward rolling or direct rolling is performed, the slab need not be heated but may be provided as it is for the multi-axial compression forming.

When a temperature of the slab to be provided for the multi-axial compression forming is lower than 950° C., diffusion of alloying elements is significantly retarded, and formation of a band-shaped structure cannot be suppressed. Accordingly, the temperature of the slab is set to 950° C. or higher and preferably set to 1020° C. or higher. On the other hand, when the temperature of the slab to be provided for the multi-axial compression forming is higher than 1300° C., a manufacturing cost increases wastefully, or an increase in scale loss reduces yields. Accordingly, the temperature of the slab is set to 1300° C. or lower and preferably set to 1250° C. or lower.

In the multi-axial compression forming, the slab at 950° C. to 1300° C. is subjected to compression forming in a width direction and compression forming in a thickness direction. The multi-axial compression forming causes a segmentation of a portion in which the alloying elements such as Mn in the slab have been concentrated and introduction of a lattice defect. Therefore, the alloying elements diffuse uniformly during the multi-axial compression forming, and the formation of the band-shaped structure in a later process is suppressed, resulting in that a very homogeneous structure is obtained. In particular, the compression forming in the width direction is effective. That is, by the multi-axial compression forming, the concentrated portion of the alloying elements existing while connecting with each other in the width direction is finely divided, resulting in uniform dispersion of the alloying elements. As a result of this, it is possible to achieve, in a short time, homogenization of a structure which cannot be achieved by diffusion of alloying elements by simple prolonged heating.

When a deformation ratio per one-time compression forming in the width direction is less than 3%, an amount of a lattice defect introduced by plastic deformation is insufficient, and the diffusion of the alloying elements is not promoted, thereby failing to suppress the formation of the band-shaped structure. Accordingly, the deformation ratio per one-time compression forming in the width direction is set to 3% or more and preferably set to 10% or more. On the other hand, when the deformation ratio per one-time compression forming in the width direction is more than 50%, slab cracking occurs, or a shape of the slab becomes nonuniform to reduce dimensional accuracy of a hot-rolled steel sheet obtained by hot rolling. Accordingly, the deformation ratio per one-time compression forming in the width direction is set to 50% or less and preferably set to 40% or less.

When a deformation ratio per one-time compression forming in the thickness direction is less than 3%, an amount of a lattice defect introduced by plastic deformation is insufficient, and the diffusion of the alloying elements is not promoted, thereby failing to suppress the formation of the band-shaped structure. Further, due to a defective shape, there is a possibility that bite of the slab into a rolling mill roll becomes defective in the hot rolling. Accordingly, the deformation ratio per one-time compression forming in the thickness direction is set to 3% or more and preferably set to 10% or more. On the other hand, when the deformation ratio per one-time compression forming in the thickness direction is more than 50%, the slab cracking occurs, or a shape of the slab becomes nonuniform to reduce the dimensional accuracy of a hot-rolled steel sheet obtained by the hot rolling. Accordingly, the deformation ratio per one-time compression forming in the thickness direction is set to 50% or less and preferably set to 40% or less.

When a difference between a rolling amount in the width direction and a rolling amount in the thickness direction is excessively large, the alloying elements such as Mn do not diffuse sufficiently in a direction perpendicular to the direction having a smaller rolling amount, thereby failing to sufficiently suppress the formation of the band-shaped structure in some cases. Particularly when the difference between the rolling amounts is more than 20%, the band-shaped structure is easy to form. Accordingly, the difference of the rolling amount between in the width direction and in the thickness direction is set to 20% or less.

Performing the multi-axial compression forming at least one time allows the suppression of the formation of the band-shaped structure. An effect of suppressing the formation of the band-shaped structure becomes remarkable by repeating the multi-axial compression forming. Accordingly, the number of times of the multi-axial compression forming is set to one or more times and preferably set to two or more times. In a case of performing two or more-time multi-axial compression forming, the slab may be reheated during intervals of the multi-axial compression forming. On the other hand, when the number of times of the multi-axial compression forming is more than five times, the manufacturing cost increases wastefully, or the increase in scale loss reduces the yields. In addition, a thickness of the slab becomes nonuniform to make the hot rolling difficult in some cases. Accordingly, the number of times of the multi-axial compression forming is preferably set to five times or less and more preferably set to four times or less.

(Hot Rolling)

In hot rolling, rough rolling of the slab after the multi-axial compression forming is performed, and finish rolling is performed thereafter. A temperature of the slab to be provided for the finish rolling is set to 1050° C. to 1150° C., and in the finish rolling, first rolling is performed, second rolling is performed thereafter, and coiling is performed at 650° C. or lower. In the first rolling, a reduction ratio in a temperature zone of 1050° C. to 1150° C. (a first reduction ratio) is set to 70% or more, and in the second rolling, a reduction ratio in a temperature zone of 850° C. to 950° C. (a second reduction ratio) is set to 50% or less.

When a temperature of the slab to be provided for the first rolling is lower than 1050° C., deformation resistance during the finish rolling is high, which makes an operation difficult. Accordingly, the temperature of the slab to be provided for the first rolling is set to 1050° C. or higher and preferably set to 1070° C. or higher. On the other hand, when the temperature of the slab to be provided for the first rolling is higher than 1150° C., the increase in scale loss reduces the yields. Accordingly, the temperature of the slab to be provided for the first rolling is set to 1150° C. or lower and preferably set to 1130° C. or lower.

In the first rolling, recrystallization occurs in the temperature zone of 1050° C. to 1150° C. (austenite single-phase region). When the reduction ratio in this temperature zone (the first reduction ratio) is less than 70%, an austenite single-phase structure having fine and spherical crystal grains cannot be obtained stably, and thereafter the band-shaped structure is easy to form. Accordingly, the first reduction ratio is set to 70% or more and preferably set to 75% or more. The first rolling may be performed in a single stand, and may be performed in a plurality of stands.

When the reduction ratio in the temperature zone of 850° C. to 950° C. (the second reduction ratio) in the second rolling is more than 50%, formation of a flat band-shaped structure caused by non-recrystallized austenite in the coiling prevents a desired standard deviation from being obtained. Accordingly, the second reduction ratio is set to 50% or less. The second rolling may be performed in a single stand, and may be performed in a plurality of stands.

When a completing temperature of the second rolling is lower than 850° C., the recrystallization does not occur sufficiently, and the band-shaped structure is easy to form. Accordingly, the completing temperature is set to 850° C. or higher and preferably set to 870° C. or higher. On the other hand, when the completing temperature is higher than 1000° C., crystal grains easily grow, which makes it difficult to obtain a fine structure. Accordingly, the completing temperature is set to 1000° C. or lower and preferably set to 950° C. or lower.

When a coiling temperature is higher than 650° C., the surface property deteriorates due to internal oxidation. Accordingly, the coiling temperature is set to 650° C. or lower, preferably set to 450° C. or lower, and more preferably set to 50° C. or lower. When a cooling rate from the temperature of finish rolling to the coiling temperature is less than 5° C./s, a homogeneous structure is difficult to obtain, and a homogeneous steel microstructure is difficult to obtain in later annealing. Accordingly, the cooling rate from the finish rolling to the coiling is set to 5° C./s or more and preferably set to 30° C./s or more. The cooling rate of 5° C./s or more can be achieved by, for example, water cooling.

(Cold Rolling)

The cold rolling is performed, for example, after pickling of a hot-rolled steel sheet. From the viewpoint of homogenizing and miniaturizing a structure of a cold-rolled steel sheet, a reduction ratio in the cold rolling is preferably set to 40% or more and more preferably set to 50% or more.

(Annealing)

As the annealing, for example, continuous annealing is performed. When an annealing temperature is lower than $(Ac_1+10)$° C., a reverse transformation process does not occur sufficiently, and a hard microstructure having an area ratio of 20% or more is not obtained. Accordingly, the annealing temperature is set to $(Ac_1+10)$° C. or higher and preferably set to $(Ac_1+20)$° C. or higher. On the other hand, when the annealing temperature is higher than $(Ac_3+100)$° C., productivity is reduced, and austenite becomes coarse grains, resulting in that ferrite having an area ratio of 5% or more is not obtained. Accordingly, the annealing temperature is set to $(Ac_3+100)$° C. or lower and preferably set to $(Ac_3+50)$° C. or lower. Here, $Ac_1$ and $Ac_3$ are temperatures defined from each component of steel, and when "% element" is set as a content (mass %) of the element, for example, "% Mn" is set as a Mn content (mass %), $Ac_1$ and $Ac_3$ are represented by the following formula 1 and formula 2 respectively.

$$Ac_1(°\,C.)=723-10.7(\%\,Mn)-16.9(\%\,Ni)+29.1(\%\,Si)+16.9(\%\,Cr) \quad \text{(formula 1)}$$

$$Ac_3(^\circ C.)=910-203\sqrt{\%C}-15.2(\%Ni)+44.7(\%Si)+104(\%V)+31.5(\%Mo) \quad \text{(formula 2)}$$

An annealing time is not limited, but is preferably set to 60 seconds or longer. This is because a non-recrystallized structure is significantly reduced and a homogeneous steel microstructure is stably secured. After the annealing, the steel sheet is preferably cooled to a first cooling stop temperature in a temperature zone of $(Ac_1+10)^\circ$ C. or lower at an average cooling rate of not less than 1° C./sec nor more than 15° C./sec (a first average cooling rate). This is because ferrite having a sufficient area ratio is secured. The first average cooling rate is more preferably set to not less than 2° C./sec nor more than 10° C./sec. It is preferable to cool the steel sheet from the temperature zone of $(Ac_1+10)^\circ$ C. or lower to a second cooling stop temperature in a temperature zone of not lower than 200° C. nor higher than 350° C. at an average cooling rate of 35° C./sec or more (a second average cooling rate) and hold it at a holding temperature in the temperature zone of not lower than 200° C. nor higher than 350° C. for 200 seconds or longer. This is because hole expandability is enhanced by securing ductility of the hard microstructure.

Thus, it is possible to manufacture the steel sheet according to the embodiment of the present invention.

Note that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

EXAMPLE

Next, examples of the present invention will be explained. Conditions in examples are condition examples employed for confirming the applicability and effects of the present invention and the present invention is not limited to these examples. The present invention can employ various conditions as long as the object of the present invention is achieved without departing from the spirit of the present invention.

First Embodiment

Slabs having chemical compositions presented in Table 1 were manufactured, and after heating the slabs at 1250° C. for one hour, multi-axial compression forming was performed under conditions presented in Table 2. Next, the slabs were reheated to 1250° C. and rough-rolled to obtain rough-rolled sheets. Thereafter, the rough-rolled sheets were reheated at 1250° C. for one hour, and by performing finish rolling under conditions presented in Table 2, hot-rolled steel sheets were obtained. Note that in this experiment, for convenience of laboratory equipment, being obliged to lower a temperature of the slabs causes the reheating to be performed, but when direct sending is possible without lowering the temperature of the slabs, the reheating need not be performed. In the finish rolling, first rolling was performed in four stages, and second rolling was performed in two stages, and after coiling, holding was performed at a coiling temperature for one hour. Thereafter, pickling of the hot-rolled steel sheets was performed, and by performing cold rolling at a reduction ratio presented in Table 2, cold-rolled steel sheets each having a thickness of 1.0 mm were obtained. Subsequently, continuous annealing was performed at temperatures presented in Table 3. In the continuous annealing, a temperature increasing rate was set to 2° C./sec, and an annealing time was set to 200 seconds. After hold for 200 seconds, cooling was performed to first cooling stop temperatures in a temperature zone of 720° C. to 600° C. at a first average cooling rate of 2.3° C./sec, further cooling was performed to 300° C. (a second cooling stop temperature) at a second average cooling rate of 40° C./sec, holding was performed at 300° C. (holding temperature) for 60 seconds, and cooling was performed to a room temperature of about 30° C. at an average cooling rate of 0.75° C./sec. The balance of each of the chemical compositions presented in Table 1 is Fe and impurities. Underlines in Table 1 indicate that numerical values thereon deviate from a range of the present invention. Underlines in Table 2 and Table 3 indicate that numerical values thereon deviate from a range suitable for manufacturing the steel sheet of the present invention.

TABLE 1

| MARK OF | CHEMICAL COMPOSITION (MASS %) | | | | | | | | $Ac_1$ | $Ac_3$ |
|---|---|---|---|---|---|---|---|---|---|---|
| STEEL | C | Si | Mn | P | S | Al | N | OTHERS | (° C.) | (° C.) |
| A1 | 0.03 | 1.0 | 2.6 | 0.01 | 0.002 | 0.03 | 0.003 | | 724 | 920 |
| B1 | 0.07 | 1.0 | 2.6 | 0.01 | 0.002 | 0.03 | 0.003 | Ti: 0.03 | 724 | 901 |
| C1 | 0.12 | 1.0 | 2.2 | 0.01 | 0.002 | 0.03 | 0.003 | Ti: 0.03 | 729 | 884 |
| D1 | 0.21 | 1.0 | 1.7 | 0.01 | 0.002 | 0.03 | 0.003 | | 734 | 862 |
| E1 | 0.07 | 0.02 | 1.7 | 0.01 | 0.002 | 0.03 | 0.003 | Cr: 0.07 | 705 | 857 |
| F1 | 0.09 | 0.2 | 2.3 | 0.01 | 0.002 | 0.03 | 0.003 | | 704 | 858 |
| G1 | 0.07 | 0.2 | 1.2 | 0.01 | 0.002 | 0.03 | 0.003 | | 716 | 865 |
| H1 | 0.09 | 1.0 | 2.3 | 0.01 | 0.002 | 0.03 | 0.003 | Nb: 0.03 | 727 | 894 |
| I1 | 0.11 | 1.1 | 2.0 | 0.01 | 0.002 | 0.03 | 0.003 | V: 0.02 | 734 | 894 |
| J1 | 0.12 | 1.0 | 1.8 | 0.01 | 0.002 | 0.03 | 0.003 | Cr: 0.5 | 741 | 884 |
| K1 | 0.12 | 0.8 | 1.8 | 0.01 | 0.002 | 0.03 | 0.003 | Mo: 0.1 | 727 | 879 |
| L1 | 0.09 | 0.7 | 2.1 | 0.01 | 0.002 | 0.03 | 0.003 | Cu: 0.12 | 721 | 880 |
| M1 | 0.10 | 1.2 | 2.0 | 0.01 | 0.002 | 0.03 | 0.003 | Ni: 0.1 | 735 | 898 |
| N1 | 0.12 | 1.0 | 2.2 | 0.01 | 0.002 | 0.03 | 0.003 | Ca: 0.002 | 729 | 884 |
| O1 | 0.13 | 1.0 | 2.0 | 0.01 | 0.002 | 0.03 | 0.003 | Mg: 0.002 | 731 | 882 |
| P1 | 0.10 | 0.5 | 2.0 | 0.01 | 0.002 | 0.03 | 0.003 | REM: 0.002 | 716 | 868 |
| Q1 | 0.09 | 1.0 | 2.0 | 0.01 | 0.002 | 0.03 | 0.003 | Zr: 0.002 | 731 | 894 |
| R1 | 0.10 | 1.1 | 2.2 | 0.01 | 0.002 | 0.03 | 0.003 | Ti: 0.03 | 731 | 895 |
| S1 | 0.11 | 1.8 | 9.6 | 0.01 | 0.002 | 0.03 | 0.003 | Cr: 1.0 | 690 | 923 |
| T1 | 0.09 | 1.5 | 7.5 | 0.01 | 0.002 | 0.03 | 0.003 | Ti: 0.01 | 703 | 916 |

TABLE 2

| | | MULTI-AXIAL COMPRESSION FORMING | | | | | FINISH ROLLING PREVIOUS STAGE (FOUR STAGES) | | |
|---|---|---|---|---|---|---|---|---|---|
| | | | | DEFORMATION RATIO (%) | | | | | |
| SAMPLE No. | MARK OF STEEL | NUMBER OF TIMES | TEMPERATURE ZONE (° C.) | WIDTH DIRECTION | THICKNESS DIRECTION | DIFFER-ENCE | START TEMPERATURE (° C.) | END TEMPERATURE (° C.) | REDUCTION RATIO (%) |
| 1 | A1 | 3 | 1020~1240 | 35 | 30 | 5 | 1121 | 1096 | 77 |
| 2 | B1 | 3 | 1020~1240 | 35 | 30 | 5 | 1115 | 1077 | 77 |
| 3 | C1 | 3 | 1020~1240 | 35 | 30 | 5 | 1132 | 1092 | 77 |
| 4 | C1 | 3 | 1020~1240 | 35 | 30 | 5 | 1128 | 1089 | 77 |
| 5 | C1 | 3 | 1020~1240 | 35 | 30 | 5 | 1045 | 1033 | 69 |
| 6 | C1 | 0 | 1020~1240 | ABSENCE | 30 | 30 | 1039 | 1014 | 69 |
| 7 | C1 | 0 | 1020~1240 | ABSENCE | 30 | 30 | 1125 | 1083 | 77 |
| 8 | C1 | 0 | 1020~1240 | ABSENCE | 30 | 30 | 1049 | 1017 | 69 |
| 9 | C1 | 3 | 1020~1240 | 35 | 30 | 5 | 1112 | 1078 | 77 |
| 10 | C1 | 3 | 1020~1240 | 35 | 30 | 5 | 1043 | 979 | 77 |
| 11 | C1 | 3 | 1020~1240 | 35 | 30 | 5 | 1135 | 1069 | 69 |
| 12 | C1 | 3 | 1020~1240 | 35 | 30 | 5 | 1131 | 1060 | 77 |
| 13 | C1 | 3 | 1020~1240 | 35 | 30 | 5 | 1128 | 1054 | 77 |
| 14 | C1 | 3 | 1020~1240 | 2 | 10 | 8 | 1135 | 1101 | 77 |
| 15 | C1 | 3 | 1020~1240 | 10 | 2 | 8 | HOT ROLLING IMPOSSIBLE | | |
| 16 | D1 | 3 | 1020~1240 | 35 | 30 | 5 | 1136 | 1096 | 77 |
| 17 | D1 | 3 | 1020~1240 | 35 | 30 | 5 | 1131 | 1092 | 77 |
| 18 | E1 | 3 | 1020~1240 | 35 | 30 | 5 | 1156 | 1108 | 77 |
| 19 | F1 | 3 | 1020~1240 | 35 | 30 | 5 | 1121 | 1089 | 77 |
| 20 | G1 | 3 | 1020~1240 | 35 | 30 | 5 | 1143 | 1101 | 77 |
| 21 | H1 | 3 | 1020~1240 | 35 | 30 | 5 | 1135 | 1093 | 77 |
| 22 | I1 | 3 | 1020~1240 | 35 | 30 | 5 | 1100 | 1071 | 77 |
| 23 | J1 | 3 | 1020~1240 | 35 | 30 | 5 | 1123 | 1085 | 77 |
| 24 | K1 | 3 | 1020~1240 | 35 | 30 | 5 | 1098 | 1081 | 77 |
| 25 | L1 | 3 | 1020~1240 | 35 | 30 | 5 | 1133 | 1102 | 77 |
| 26 | M1 | 3 | 1020~1240 | 35 | 30 | 5 | 1093 | 1078 | 77 |
| 27 | N1 | 3 | 1020~1240 | 35 | 30 | 5 | 1079 | 1064 | 77 |
| 28 | O1 | 3 | 1020~1240 | 35 | 30 | 5 | 1140 | 1092 | 77 |
| 29 | P1 | 3 | 1020~1240 | 35 | 30 | 5 | 1096 | 1078 | 77 |
| 30 | Q1 | 3 | 1020~1240 | 35 | 30 | 5 | 1101 | 1081 | 77 |
| 31 | R1 | 1 | 880~950 | 20 | 20 | 0 | 1128 | 1089 | 77 |
| 32 | F1 | 3 | 1020~1240 | 35 | 30 | 5 | 1121 | 1087 | 77 |
| 33 | D1 | 3 | 1020~1240 | 35 | 30 | 5 | 1098 | 1051 | 77 |
| 34 | C1 | 1 | 1020~1240 | 35 | 30 | 5 | 1135 | 1096 | 77 |
| 35 | C1 | 1 | 1020~1240 | 5 | 30 | 25 | 1129 | 1093 | 77 |
| 36 | S1 | 3 | 1020~1240 | 35 | 30 | 5 | 1126 | 1090 | 77 |
| 37 | T1 | 3 | 1020~1240 | 35 | 30 | 5 | 1131 | 1100 | 77 |

| | FINISH ROLLING SUBSEQUENT STAGE (TWO STAGES) | | | | COLD ROLLING | |
|---|---|---|---|---|---|---|
| SAMPLE No. | START TEMPERATURE (° C.) | END TEMPERATURE (° C.) | REDUCTION RATIO (%) | COILING TEMPERATURE (° C.) | REDUCTION RATIO (%) | REMARK |
| 1 | 941 | 889 | 49 | 600 | 58 | COMPARATIVE EXAMPLE |
| 2 | 939 | 880 | 49 | 600 | 58 | INVENTION EXAMPLE |
| 3 | 919 | 896 | 49 | 30 | 58 | INVENTION EXAMPLE |
| 4 | 935 | 915 | 49 | 600 | 58 | INVENTION EXAMPLE |
| 5 | 923 | 842 | 60 | 600 | 58 | COMPARATIVE EXAMPLE |
| 6 | 898 | 830 | 60 | 30 | 58 | COMPARATIVE EXAMPLE |
| 7 | 942 | 894 | 49 | 600 | 58 | COMPARATIVE EXAMPLE |
| 8 | 892 | 841 | 60 | 600 | 58 | COMPARATIVE EXAMPLE |
| 9 | 942 | 874 | 49 | 600 | 58 | COMPARATIVE EXAMPLE |
| 10 | 933 | 861 | 49 | 600 | 58 | COMPARATIVE EXAMPLE |
| 11 | 941 | 864 | 49 | 600 | 58 | COMPARATIVE EXAMPLE |
| 12 | 843 | 752 | 49 | 600 | 58 | COMPARATIVE EXAMPLE |
| 13 | 934 | 859 | 60 | 600 | 58 | COMPARATIVE EXAMPLE |
| 14 | 938 | 910 | 49 | 600 | 58 | COMPARATIVE EXAMPLE |
| 15 | HOT ROLLING IMPOSSIBLE | | | | | COMPARATIVE EXAMPLE |
| 16 | 941 | 915 | 49 | 600 | 58 | INVENTION EXAMPLE |
| 17 | 938 | 872 | 49 | 600 | 58 | COMPARATIVE EXAMPLE |
| 18 | 955 | 893 | 49 | 600 | 58 | COMPARATIVE EXAMPLE |
| 19 | 929 | 869 | 49 | 600 | 58 | INVENTION EXAMPLE |
| 20 | 896 | 853 | 49 | 600 | 58 | COMPARATIVE EXAMPLE |
| 21 | 922 | 859 | 49 | 600 | 58 | INVENTION EXAMPLE |
| 22 | 928 | 855 | 49 | 600 | 58 | INVENTION EXAMPLE |
| 23 | 911 | 863 | 49 | 600 | 58 | INVENTION EXAMPLE |

TABLE 2-continued

| | | | | | | |
|---|---|---|---|---|---|---|
| 24 | 938 | 921 | 49 | 600 | 58 | INVENTION EXAMPLE |
| 25 | 943 | 936 | 49 | 600 | 58 | INVENTION EXAMPLE |
| 26 | 929 | 897 | 49 | 600 | 58 | INVENTION EXAMPLE |
| 27 | 923 | 881 | 49 | 600 | 58 | INVENTION EXAMPLE |
| 28 | 949 | 920 | 49 | 600 | 58 | INVENTION EXAMPLE |
| 29 | 941 | 896 | 49 | 600 | 58 | INVENTION EXAMPLE |
| 30 | 935 | 906 | 49 | 600 | 58 | INVENTION EXAMPLE |
| 31 | 932 | 915 | 49 | 600 | 58 | COMPARATIVE EXAMPLE |
| 32 | 931 | 873 | 49 | 600 | 58 | COMPARATIVE EXAMPLE |
| 33 | 926 | 886 | 49 | 600 | 58 | COMPARATIVE EXAMPLE |
| 34 | 943 | 906 | 49 | 600 | 58 | INVENTION EXAMPLE |
| 35 | 941 | 905 | 49 | 600 | 58 | COMPARATIVE EXAMPLE |
| 36 | 949 | 924 | 49 | 600 | 58 | INVENTION EXAMPLE |
| 37 | 936 | 908 | 49 | 600 | 58 | INVENTION EXAMPLE |

TABLE 3

| | | ANNEALING | | | | | |
|---|---|---|---|---|---|---|---|
| SAMPLE No. | MARK OF STEEL | TEMPERATURE INCREASING RATE (° C./s) | TEMPERATURE (° C.) | TIME (s) | FIRST AVERAGE COOLING RATE (° C./s) | FIRST COOLING STOP TEMPERATURE (° C.) | SECOND AVERAGE COOLING RATE (° C./s) |
| 1 | A1 | 2 | 850 | 200 | 2.3 | 630 | 40 |
| 2 | B1 | 2 | 850 | 200 | 2.3 | 650 | 40 |
| 3 | C1 | 2 | 850 | 200 | 2.3 | 650 | 40 |
| 4 | C1 | 2 | 850 | 200 | 2.3 | 650 | 40 |
| 5 | C1 | 2 | 850 | 200 | 2.3 | 650 | 40 |
| 6 | C1 | 2 | 850 | 200 | 2.3 | 680 | 40 |
| 7 | C1 | 2 | 850 | 200 | 2.3 | 680 | 40 |
| 8 | C1 | 2 | 850 | 200 | 2.3 | 660 | 40 |
| 9 | C1 | 2 | 730 | 200 | 2.3 | 645 | 40 |
| 10 | C1 | 2 | 850 | 200 | 2.3 | 650 | 40 |
| 11 | C1 | 2 | 850 | 200 | 2.3 | 650 | 40 |
| 12 | C1 | 2 | 850 | 200 | 2.3 | 645 | 40 |
| 13 | C1 | 2 | 850 | 200 | 2.3 | 650 | 40 |
| 14 | C1 | 2 | 850 | 200 | 2.3 | 650 | 40 |
| 15 | C1 | HOT ROLLING IMPOSSIBLE | | | | | |
| 16 | D1 | 2 | 850 | 200 | 2.3 | 700 | 40 |
| 17 | D1 | 2 | 1000 | 200 | 2.3 | 710 | 40 |
| 18 | E1 | 2 | 850 | 200 | 2.3 | 630 | 40 |
| 19 | F1 | 2 | 850 | 200 | 2.3 | 640 | 40 |
| 20 | G1 | 2 | 850 | 200 | 2.3 | 630 | 40 |
| 21 | H1 | 2 | 850 | 200 | 2.3 | 645 | 40 |
| 22 | I1 | 2 | 850 | 200 | 2.3 | 650 | 40 |
| 23 | J1 | 2 | 850 | 200 | 2.3 | 700 | 40 |
| 24 | K1 | 2 | 850 | 200 | 2.3 | 680 | 40 |
| 25 | L1 | 2 | 850 | 200 | 2.3 | 680 | 40 |
| 26 | M1 | 2 | 850 | 200 | 2.3 | 680 | 40 |
| 27 | N1 | 2 | 850 | 200 | 2.3 | 650 | 40 |
| 28 | O1 | 2 | 850 | 200 | 2.3 | 680 | 40 |
| 29 | P1 | 2 | 850 | 200 | 2.3 | 680 | 40 |
| 30 | Q1 | 2 | 850 | 200 | 2.3 | 670 | 40 |
| 31 | R1 | 2 | 850 | 200 | 2.3 | 680 | 40 |
| 32 | F1 | 2 | 710 | 200 | 2.3 | 600 | 40 |
| 33 | D1 | 2 | 980 | 200 | 2.3 | 710 | 40 |
| 34 | C1 | 2 | 920 | 200 | 2.3 | 670 | 40 |
| 35 | C1 | 2 | 850 | 200 | 2.3 | 670 | 40 |
| 36 | S1 | 2 | 830 | 200 | 2.3 | 630 | 40 |
| 37 | T1 | 2 | 850 | 200 | 2.3 | 610 | 40 |

| | ANNEALING | | | | | |
|---|---|---|---|---|---|---|
| SAMPLE No. | SECOND COOLING STOP TEMPERATURE (° C.) | HOLDING TEMPERATURE (° C.) | HOLDING TIME (s) | $Ac_1$ (° C.) | $Ac_3$ (° C.) | REMARK |
| 1 | 300 | 300 | 60 | 724 | 920 | COMPARATIVE EXAMPLE |
| 2 | 300 | 300 | 60 | 724 | 901 | INVENTION EXAMPLE |
| 3 | 300 | 300 | 60 | 729 | 884 | INVENTION EXAMPLE |
| 4 | 300 | 300 | 60 | 729 | 884 | INVENTION EXAMPLE |
| 5 | 300 | 300 | 60 | 729 | 884 | COMPARATIVE EXAMPLE |
| 6 | 300 | 300 | 60 | 729 | 884 | COMPARATIVE EXAMPLE |
| 7 | 300 | 300 | 60 | 729 | 884 | COMPARATIVE EXAMPLE |
| 8 | 300 | 300 | 60 | 729 | 884 | COMPARATIVE EXAMPLE |
| 9 | 300 | 300 | 60 | 729 | 884 | COMPARATIVE EXAMPLE |

TABLE 3-continued

| | | | | | | |
|---|---|---|---|---|---|---|
| 10 | 300 | 300 | 60 | 729 | 884 | COMPARATIVE EXAMPLE |
| 11 | 300 | 300 | 60 | 729 | 884 | COMPARATIVE EXAMPLE |
| 12 | 300 | 300 | 60 | 729 | 884 | COMPARATIVE EXAMPLE |
| 13 | 300 | 300 | 60 | 729 | 884 | COMPARATIVE EXAMPLE |
| 14 | 300 | 300 | 60 | 729 | 884 | COMPARATIVE EXAMPLE |
| 15 | HOT ROLLING IMPOSSIBLE | | | 729 | 884 | COMPARATIVE EXAMPLE |
| 16 | 300 | 300 | 60 | 734 | 862 | INVENTION EXAMPLE |
| 17 | 300 | 300 | 60 | 734 | 862 | COMPARATIVE EXAMPLE |
| 18 | 300 | 300 | 60 | 705 | 857 | COMPARATIVE EXAMPLE |
| 19 | 300 | 300 | 60 | 704 | 858 | INVENTION EXAMPLE |
| 20 | 300 | 300 | 60 | 716 | 865 | COMPARATIVE EXAMPLE |
| 21 | 300 | 300 | 60 | 727 | 894 | INVENTION EXAMPLE |
| 22 | 300 | 300 | 60 | 734 | 894 | INVENTION EXAMPLE |
| 23 | 300 | 300 | 60 | 741 | 884 | INVENTION EXAMPLE |
| 24 | 300 | 300 | 60 | 727 | 879 | INVENTION EXAMPLE |
| 25 | 300 | 300 | 60 | 721 | 880 | INVENTION EXAMPLE |
| 26 | 300 | 300 | 60 | 735 | 898 | INVENTION EXAMPLE |
| 27 | 300 | 300 | 60 | 729 | 884 | INVENTION EXAMPLE |
| 28 | 300 | 300 | 60 | 731 | 882 | INVENTION EXAMPLE |
| 29 | 300 | 300 | 60 | 716 | 868 | INVENTION EXAMPLE |
| 30 | 300 | 300 | 60 | 731 | 894 | INVENTION EXAMPLE |
| 31 | 300 | 300 | 60 | 731 | 895 | COMPARATIVE EXAMPLE |
| 32 | 300 | 300 | 60 | 704 | 858 | COMPARATIVE EXAMPLE |
| 33 | 300 | 300 | 60 | 734 | 862 | COMPARATIVE EXAMPLE |
| 34 | 300 | 300 | 60 | 729 | 884 | INVENTION EXAMPLE |
| 35 | 300 | 300 | 60 | 729 | 884 | COMPARATIVE EXAMPLE |
| 36 | 300 | 300 | 60 | 690 | 923 | INVENTION EXAMPLE |
| 37 | 300 | 300 | 60 | 703 | 916 | INVENTION EXAMPLE |

Then, steel microstructures of the obtained cold-rolled steel sheets were observed. In the observation of each of the steel microstructures, by the above-described method, an area ratio of ferrite, an area ratio of a hard microstructure (a total area ratio of bainite, martensite and retained austenite), a total area ratio of pearlite and carbide, and a standard deviation of a line fraction of the hard microstructure were measured. Table 4 presents these results. Underlines in Table 4 indicate that numerical values thereon deviate from a range of the present invention.

Moreover, a tensile strength TS, a fracture elongation EL, and a hole expansion ratio HER of each of the obtained cold-rolled steel sheets were measured. In the measurement of the tensile strength TS and the fracture elongation EL, a JIS No. 5 tensile test piece in which a direction orthogonal to a rolling direction was set as a longitudinal direction was picked, and a tensile test was performed in conformity to JIS Z 2241. In the measurement of the hole expansion ratio HER, from each of the cold-rolled steel sheets, a 90 mm square test piece was picked, a hole expansion test conforming to the standard of JIS Z 2256 (or JIS T 1001) was performed. At this time, a hole expansion test rate was set to 1 mm/sec. Table 4 also presents these results. Underlines in Table 4 indicate that numerical values thereon deviate from desirable ranges. The desirable ranges mentioned here mean that the tensile strength TS is 780 MPa or more, the fracture elongation EL is 10% or more, and the hole expansion ratio HER is 30% or more.

In addition, an appearance inspection at a time of molding was performed in a visual manner. The appearance inspection was performed by the following method. First, each of the steel sheets was cut into 40 mm in width×100 mm in length, and was obtained as a test piece by polishing its surface until metallic luster was able to be seen. The test piece was subjected to a 90-degree V-bending test at two levels in which a ratio (R/t) between a sheet thickness t and a bend radius R was 2.0 and 2.5 under a condition in which a bending edge line became a rolling direction. After the test, a surface property of a bent portion was observed in a visual manner. A case where an uneven appearance or a crack was recognized on a surface in a test in which the ratio (R/t) was 2.5 was judged poor. A case where an uneven appearance and a crack were not recognized in the test in which the ratio (R/t) was 2.5 but an uneven appearance or a crack was recognized on a surface in a test in which the ratio (R/t) was 2.0 was judged good. A case where an uneven appearance and a crack were not recognized on a surface in either of the test in which the ratio (R/t) was 2.5 and the test in which the ratio (R/t) was 2.0 was judged excellent. Table 4 also presents this result.

TABLE 4

| | | STEEL MICROSTRUCTURE | | | | | MECHANICAL PROPERTY | | | | | |
|---|---|---|---|---|---|---|---|---|---|---|---|---|
| SAMPLE No. | MARK OF STEEL | AREA RATIO OF FERRITE (%) | AREA RATIO OF HARD MICROSTRUCTURE (%) | TOTAL AREA RATIO OF PEARLITE AND CARBIDE (%) | AREA RATIO OF RETAINED γ (%) | STANDARD DEVIATION (%) | TS (MPa) | EL (%) | HER (%) | TS* HER (MPa · %) | APPEARANCE | REMARK |
| 1 | A1 | 90.2 | 9.3 | 0.5 | 3.2 | 0.0312 | 515 | 36.9 | 84.2 | 43392.4 | GOOD | COMPARATIVE EXAMPLE |
| 2 | B1 | 78.6 | 20.4 | 1.0 | 7.1 | 0.0361 | 781 | 24.8 | 33.6 | 26241.6 | GOOD | INVENTION EXAMPLE |
| 3 | C1 | 72.8 | 24.1 | 3.1 | 5.1 | 0.0392 | 855 | 20.9 | 34.1 | 29155.5 | GOOD | INVENTION EXAMPLE |
| 4 | C1 | 73.7 | 23.8 | 2.5 | 6.3 | 0.0379 | 841 | 20.1 | 38.4 | 32294.4 | GOOD | INVENTION EXAMPLE |
| 5 | C1 | 75.1 | 21.3 | 3.6 | 5.4 | 0.0610 | 840 | 19.1 | 29.5 | 24780.0 | POOR | COMPARATIVE EXAMPLE |
| 6 | C1 | 61.3 | 34.8 | 3.9 | 5.3 | 0.0548 | 880 | 18.9 | 25.2 | 22176.0 | POOR | COMPARATIVE EXAMPLE |
| 7 | C1 | 65.4 | 31.4 | 3.2 | 6.1 | 0.0527 | 906 | 19.8 | 28.5 | 25821.0 | POOR | COMPARATIVE EXAMPLE |
| 8 | C1 | 71.1 | 26.6 | 2.3 | 5.5 | 0.0782 | 907 | 18.6 | 25.3 | 22947.1 | POOR | COMPARATIVE EXAMPLE |
| 9 | C1 | 82.7 | 9.1 | 8.2 | 2.8 | 0.0344 | 689 | 30.1 | 76.3 | 52570.7 | GOOD | COMPARATIVE EXAMPLE |
| 10 | C1 | 71.3 | 24.7 | 4.0 | 5.6 | 0.0599 | 873 | 18.7 | 26.9 | 23483.7 | POOR | COMPARATIVE EXAMPLE |
| 11 | C1 | 72.7 | 24.9 | 2.4 | 5.9 | 0.0512 | 861 | 19.1 | 27.3 | 23505.3 | POOR | COMPARATIVE EXAMPLE |
| 12 | C1 | 68.2 | 28.2 | 3.6 | 6.0 | 0.0612 | 896 | 18.3 | 26.1 | 23385.6 | POOR | COMPARATIVE EXAMPLE |
| 13 | C1 | 71.8 | 26.4 | 1.8 | 5.3 | 0.0548 | 888 | 17.2 | 27.0 | 23976.0 | POOR | COMPARATIVE EXAMPLE |
| 14 | C1 | 74.0 | 23.5 | 2.5 | 8.1 | 0.0523 | 873 | 21.2 | 28.9 | 25229.7 | POOR | COMPARATIVE EXAMPLE |
| 15 | C1 | | | | MEASUREMENT IMPOSSIBLE | | | | | | | COMPARATIVE EXAMPLE |
| 16 | D1 | 30.1 | 65.9 | 4.0 | 4.8 | 0.0438 | 1189 | 11.9 | 31.3 | 37215.7 | GOOD | INVENTION EXAMPLE |
| 17 | D1 | 4.4 | 89.6 | 6.0 | 9.1 | 0.0199 | 1493 | 6.2 | 73.2 | 109287.6 | GOOD | COMPARATIVE EXAMPLE |
| 18 | E1 | 80.2 | 19.4 | 0.4 | 5.3 | 0.0318 | 683 | 24.2 | 50.2 | 34278.6 | GOOD | COMPARATIVE EXAMPLE |
| 19 | F1 | 72.5 | 23.8 | 3.7 | 8.3 | 0.0365 | 789 | 24.1 | 39.6 | 31244.4 | GOOD | INVENTION EXAMPLE |
| 20 | G1 | 81.0 | 16.9 | 2.1 | 5.1 | 0.0342 | 622 | 26.5 | 48.0 | 29849.1 | GOOD | COMPARATIVE EXAMPLE |
| 21 | H1 | 73.8 | 25.1 | 1.1 | 5.6 | 0.0298 | 812 | 23.5 | 30.5 | 24766.0 | GOOD | INVENTION EXAMPLE |
| 22 | I1 | 70.5 | 26.0 | 3.5 | 5.9 | 0.0396 | 819 | 21.4 | 31.1 | 25467.6 | GOOD | INVENTION EXAMPLE |
| 23 | J1 | 31.0 | 64.3 | 4.7 | 9.3 | 0.0394 | 1116 | 16.3 | 32.1 | 35823.6 | GOOD | INVENTION EXAMPLE |
| 24 | K1 | 65.1 | 31.8 | 3.1 | 7.9 | 0.0401 | 926 | 16.9 | 31.0 | 28701.5 | GOOD | INVENTION EXAMPLE |
| 25 | L1 | 67.3 | 30.6 | 2.1 | 5.7 | 0.0384 | 862 | 20.1 | 35.9 | 30957.9 | GOOD | INVENTION EXAMPLE |
| 26 | M1 | 67.4 | 29.2 | 3.4 | 5.3 | 0.0394 | 840 | 19.3 | 36.2 | 30416.3 | GOOD | INVENTION EXAMPLE |
| 27 | N1 | 69.7 | 28.4 | 1.9 | 5.3 | 0.0412 | 898 | 17.4 | 30.3 | 27218.8 | GOOD | INVENTION EXAMPLE |
| 28 | O1 | 62.2 | 34.0 | 3.8 | 6.2 | 0.0349 | 928 | 17.3 | 32.6 | 30262.8 | GOOD | INVENTION EXAMPLE |
| 29 | P1 | 65.9 | 32.5 | 1.6 | 5.1 | 0.0376 | 870 | 16.2 | 37.0 | 32207.1 | GOOD | INVENTION EXAMPLE |
| 30 | Q1 | 71.6 | 27.1 | 1.3 | 6.4 | 0.0390 | 824 | 20.5 | 38.4 | 31654.4 | GOOD | INVENTION EXAMPLE |
| 31 | R1 | 70.3 | 29.7 | 0.0 | 6.2 | 0.0538 | 893 | 19.3 | 27.6 | 24646.8 | POOR | COMPARATIVE EXAMPLE |
| 32 | F1 | 78.3 | 19.8 | 1.9 | 5.2 | 0.0352 | 776 | 25.0 | 38.3 | 29720.8 | GOOD | COMPARATIVE EXAMPLE |
| 33 | D1 | 3.8 | 95.5 | 0.7 | 9.0 | 0.0218 | 1543 | 5.3 | 48.3 | 74526.9 | GOOD | COMPARATIVE EXAMPLE |
| 34 | C1 | 69.9 | 30.1 | 0.0 | 5.3 | 0.0462 | 913 | 14.9 | 32.1 | 29307.3 | GOOD | INVENTION EXAMPLE |
| 35 | C1 | 70.5 | 27.3 | 2.2 | 5.5 | 0.0508 | 901 | 20.1 | 26.1 | 23516.1 | POOR | COMPARATIVE EXAMPLE |
| 36 | S1 | 42.3 | 57.7 | 0.9 | 16.3 | 0.0485 | 1168 | 15.8 | 31.0 | 36208.0 | GOOD | INVENTION EXAMPLE |
| 37 | T1 | 54.3 | 45.7 | 1.6 | 12.6 | 0.0398 | 999 | 16.0 | 35.0 | 34965.0 | GOOD | INVENTION EXAMPLE |

As presented in Table 4, in each of samples No. 2 to No. 4, No. 16, No. 19, No. 21 to No. 30, No. 33, No. 36, and No. 37 which were in the present invention range, it was possible to obtain excellent tensile strength, fracture elongation and hole expandability. Among these, in each of samples No. 23 and so on, since an area ratio of retained austenite (retained γ) was 5.0% or more, fracture elongation more excellent than that in a sample No. 16 was obtained.

On the other hand, in a sample No. 1, since the C content was too low, an area ratio of ferrite was too high, and an area ratio of a hard microstructure was too low, tensile strength was low. In a sample No. 18, since the Si content was too low and an area ratio of ferrite was too low, tensile strength was low. In a sample No. 20, since the Mn content was too low and an area ratio of ferrite was too low, tensile strength was low.

In each of samples No. 5 to No. 8, No. 10 to No. 14, No. 31, and No. 35, since a standard deviation of a line fraction of a hard microstructure was too large, a hole expansion ratio was low. In a sample No. 9, since an area ratio of ferrite was too high and an area ratio of a hard microstructure was too low, tensile strength and hole expansion ratio were low. In a sample No. 15, since a deformation ratio in a width direction in the multi-axial compression forming was too low, hot rolling was not able to be performed thereafter. In a sample No. 17, since an area ratio of ferrite was too low, fracture elongation was low. In a sample No. 32, since an area ratio of a hard microstructure was too low, tensile strength was low. In a sample No. 33, since an area ratio of a hard microstructure was too high, fracture elongation was low.

Second Example

Slabs having chemical compositions presented in Table 5 were manufactured, and after heating the slabs at 1250° C. for one hour, multi-axial compression forming was performed under conditions presented in Table 6. Next, the slabs were reheated to 1250° C. and rough-rolled to obtain rough-rolled sheets. Thereafter, the rough-rolled sheets were reheated at 1250° C. for one hour, and by performing finish rolling under conditions presented in Table 6, hot-rolled steel sheets were obtained. Note that in this experiment, for convenience of laboratory equipment, being obliged to lower a temperature of the slabs causes the reheating to be performed, but when direct sending is possible without lowering the temperature of the slabs, the reheating need not be performed. In the finish rolling, first rolling was performed in four stages, and second rolling was performed in two stages, and after coiling, holding was performed at a coiling temperature for one hour. Thereafter, pickling of the hot-rolled steel sheets was performed, and by performing cold rolling at reduction ratios presented in Table 6, cold-rolled steel sheets each having a thickness of 1.0 mm were obtained. Subsequently, continuous annealing was performed at temperatures presented in Table 7. In the continuous annealing, temperature increasing rates were set to rates presented in Table 7, and an annealing time was set to 100 seconds. After hold for 100 seconds, cooling was performed to first cooling stop temperatures presented in Table 7 at first average cooling rates presented in Table 7, further cooling was performed to second cooling stop temperatures presented in Table 7 at a second average cooling rate of 40° C./sec, holding was performed at holding temperatures presented in Table 7 for 300 seconds, and cooling was performed to a room temperature of about 30° C. at an average cooling rate of 10° C./sec. The balance of each of the chemical compositions presented in Table 5 is Fe and impurities. Underlines in Table 5 indicate that numerical values thereon deviate from a range of the present invention. Underlines in Table 6 and Table 7 indicate that numerical values thereon deviate from a range suitable for manufacturing the steel sheet of the present invention.

TABLE 5

| MARK OF | CHEMICAL COMPOSITION (MASS %) | | | | | | | | $Ac_1$ | $Ac_3$ |
|---|---|---|---|---|---|---|---|---|---|---|
| STEEL | C | Si | Mn | P | S | Al | N | OTHERS | (° C.) | (° C.) |
| A2 | 0.03 | 2.1 | 2.3 | 0.01 | 0.002 | 0.03 | 0.003 | | 760 | 969 |
| B2 | 0.07 | 2.1 | 2.1 | 0.01 | 0.002 | 0.03 | 0.003 | | 762 | 950 |
| C2 | 0.13 | 3.0 | 2.2 | 0.01 | 0.002 | 0.03 | 0.003 | | 787 | 971 |
| D2 | 0.10 | 0.04 | 1.8 | 0.01 | 0.002 | 0.03 | 0.003 | | 705 | 848 |
| E2 | 0.15 | 6.1 | 3.9 | 0.01 | 0.002 | 0.03 | 0.003 | | 859 | 1104 |
| F2 | 0.10 | 2.2 | 1.4 | 0.01 | 0.002 | 0.03 | 0.003 | | 772 | 944 |
| G2 | 0.30 | 4.6 | 3.8 | 0.01 | 0.002 | 0.03 | 0.003 | | 816 | 1004 |
| H2 | 0.18 | 2.6 | 2.5 | 0.01 | 0.002 | 0.03 | 0.003 | Ti: 0.03 | 772 | 940 |
| I2 | 0.19 | 3.0 | 2.3 | 0.01 | 0.002 | 0.03 | 0.003 | Nb: 0.03 | 786 | 956 |
| J2 | 0.22 | 2.5 | 2.4 | 0.01 | 0.002 | 0.03 | 0.003 | V: 0.02 | 770 | 929 |
| K2 | 0.22 | 3.0 | 2.6 | 0.01 | 0.002 | 0.03 | 0.003 | Cr: 0.5 | 791 | 949 |
| L2 | 0.22 | 3.3 | 3.1 | 0.01 | 0.002 | 0.03 | 0.003 | Mo: 0.1 | 786 | 965 |
| M2 | 0.20 | 2.7 | 2.5 | 0.01 | 0.002 | 0.03 | 0.003 | Cu: 0.12 | 775 | 940 |
| N2 | 0.20 | 2.6 | 2.5 | 0.01 | 0.002 | 0.03 | 0.003 | Ni: 0.1 | 770 | 934 |
| O2 | 0.23 | 2.5 | 2.2 | 0.01 | 0.002 | 0.03 | 0.003 | Ca: 0.002 | 772 | 924 |
| P2 | 0.23 | 2.5 | 2.4 | 0.01 | 0.002 | 0.03 | 0.003 | Mg: 0.002 | 770 | 924 |
| Q2 | 0.20 | 2.9 | 2.3 | 0.01 | 0.002 | 0.03 | 0.003 | REM: 0.002 | 783 | 949 |
| R2 | 0.20 | 2.9 | 2.6 | 0.01 | 0.002 | 0.03 | 0.003 | Zr: 0.002 | 780 | 949 |
| S2 | 0.12 | 2.1 | 1.8 | 0.01 | 0.002 | 0.03 | 0.003 | Zr: 0.001 | 765 | 934 |
| T2 | 0.31 | 2.5 | 9.6 | 0.01 | 0.002 | 0.03 | 0.003 | | 693 | 909 |
| U2 | 0.25 | 2.4 | 7.5 | 0.01 | 0.002 | 0.03 | 0.003 | | 713 | 916 |
| V2 | 0.07 | 2.5 | 2.8 | 0.01 | 0.002 | 0.03 | 0.003 | | 766 | 968 |
| W2 | 0.25 | 5.5 | 3.5 | 0.01 | 0.002 | 0.03 | 0.003 | Ni: 2.0 | 846 | 1024 |

TABLE 6

| | | MULTI-AXIAL COMPRESSION FORMING | | | | | FINISH ROLLING | | |
|---|---|---|---|---|---|---|---|---|---|
| | | | | DEFORMATION RATIO (%) | | | PREVIOUS STAGE (FOUR STAGES) | | |
| SAMPLE No. | MARK OF STEEL | NUMBER OF TIMES | TEMPERATURE ZONE (° C.) | WIDTH DIRECTION | THICK-NESS DIRECTION | DIFFER-ENCE | START TEMPERATURE (° C.) | END TEMPERATURE (° C.) | REDUCTION RATIO (%) |
| 41 | A2 | 3 | 1020~1240 | 35 | 30 | 30 | 1149 | 1096 | 75 |
| 42 | B2 | 3 | 1020~1240 | 35 | 30 | 5 | 1141 | 1092 | 75 |
| 43 | C2 | 3 | 1020~1240 | 35 | 30 | 5 | 1146 | 1100 | 75 |
| 44 | C2 | 3 | 1020~1240 | 35 | 30 | 5 | 1100 | 1063 | 65 |
| 45 | C2 | 3 | 1020~1240 | 2 | 10 | 8 | 1099 | 1061 | 75 |
| 46 | C2 | 3 | 1020~1240 | 35 | 30 | 5 | 1105 | 1057 | 75 |
| 47 | C2 | 3 | 1020~1240 | 10 | 2 | 8 | HOT ROLLING IMPOSSIBLE | | |
| 48 | C2 | 1 | 1020~1240 | 5 | 30 | 25 | 1111 | 1069 | 75 |
| 49 | C2 | 1 | 1020~1240 | 35 | 30 | 5 | 1128 | 1099 | 75 |
| 50 | C2 | 0 | 1020~1240 | ABSENCE | 30 | 30 | 1140 | 1090 | 75 |
| 51 | D2 | 3 | 1020~1240 | 35 | 30 | 5 | 1129 | 1100 | 75 |
| 52 | E2 | 3 | 1020~1240 | 35 | 30 | 5 | 1149 | 1088 | 75 |
| 53 | F2 | 3 | 1020~1240 | 35 | 30 | 5 | 1140 | 1086 | 75 |
| 54 | G2 | 3 | 1020~1240 | 35 | 30 | 5 | 1145 | 1081 | 75 |
| 55 | H2 | 3 | 1020~1240 | 35 | 30 | 5 | 1131 | 1073 | 75 |
| 56 | H2 | 3 | 1020~1240 | 35 | 30 | 5 | 1136 | 1076 | 75 |
| 57 | H2 | 1 | 880~950 | 20 | 20 | 0 | 1129 | 1063 | 80 |
| 58 | I2 | 3 | 1020~1240 | 35 | 30 | 5 | 1129 | 1093 | 75 |
| 59 | J2 | 3 | 1020~1240 | 35 | 30 | 5 | 1142 | 1096 | 75 |
| 60 | K2 | 3 | 1020~1240 | 35 | 30 | 5 | 1142 | 1092 | 75 |
| 61 | L2 | 3 | 1020~1240 | 35 | 30 | 5 | 1139 | 1086 | 75 |
| 62 | M2 | 3 | 1020~1240 | 35 | 30 | 5 | 1106 | 1057 | 75 |
| 63 | N2 | 3 | 1020~1240 | 35 | 30 | 5 | 1103 | 1054 | 75 |
| 64 | N2 | 3 | 1020~1240 | 35 | 30 | 5 | 1121 | 1057 | 75 |
| 65 | O2 | 3 | 1020~1240 | 35 | 30 | 5 | 1134 | 1081 | 75 |
| 66 | P2 | 3 | 1020~1240 | 35 | 30 | 5 | 1109 | 1050 | 75 |
| 67 | Q2 | 3 | 1020~1240 | 35 | 30 | 5 | 1121 | 1061 | 75 |
| 68 | R2 | 3 | 1020~1240 | 35 | 30 | 5 | 1136 | 1077 | 75 |
| 69 | S2 | 3 | 1020~1240 | 35 | 30 | 5 | 1140 | 1086 | 75 |
| 70 | T2 | 3 | 1020~1240 | 35 | 30 | 5 | 1106 | 1051 | 75 |
| 71 | U2 | 3 | 1020~1240 | 35 | 30 | 5 | 1107 | 1044 | 75 |
| 72 | V2 | 3 | 1020~1240 | 35 | 30 | 5 | 1099 | 1035 | 75 |
| 73 | W2 | 3 | 1020~1240 | 35 | 30 | 5 | 1145 | 1091 | 75 |

| | FINISH ROLLING | | | | |
|---|---|---|---|---|---|
| | SUBSEQUENT STAGE (TWO STAGES) | | | COLD ROLLING | |
| SAMPLE No. | END TEMPERATURE (° C.) | REDUCTION RATIO (%) | COILING TEMPERATURE (° C.) | REDUCTION RATIO (%) | REMARK |
| 41 | 905 | 45 | 600 | 50 | COMPARATIVE EXAMPLE |
| 42 | 894 | 45 | 600 | 55 | INVENTION EXAMPLE |
| 43 | 913 | 45 | 600 | 50 | INVENTION EXAMPLE |
| 44 | 879 | 45 | 600 | 50 | COMPARATIVE EXAMPLE |
| 45 | 883 | 45 | 600 | 55 | COMPARATIVE EXAMPLE |
| 46 | 903 | 45 | 600 | 50 | COMPARATIVE EXAMPLE |
| 47 | HOT ROLLING IMPOSSIBLE | | | | COMPARATIVE EXAMPLE |
| 48 | 889 | 45 | 600 | 50 | COMPARATIVE EXAMPLE |
| 49 | 911 | 45 | 600 | 50 | INVENTION EXAMPLE |
| 50 | 896 | 45 | 600 | 50 | COMPARATIVE EXAMPLE |
| 51 | 890 | 45 | 600 | 50 | COMPARATIVE EXAMPLE |
| 52 | 899 | 45 | 600 | 50 | COMPARATIVE EXAMPLE |
| 53 | 899 | 45 | 600 | 50 | COMPARATIVE EXAMPLE |
| 54 | 913 | 45 | 600 | 50 | INVENTION EXAMPLE |
| 55 | 890 | 45 | 600 | 50 | COMPARATIVE EXAMPLE |
| 56 | 883 | 45 | 600 | 50 | INVENTION EXAMPLE |
| 57 | 883 | 45 | 600 | 55 | COMPARATIVE EXAMPLE |
| 58 | 891 | 45 | 600 | 50 | INVENTION EXAMPLE |
| 59 | 894 | 45 | 600 | 50 | INVENTION EXAMPLE |
| 60 | 901 | 45 | 600 | 50 | INVENTION EXAMPLE |
| 61 | 900 | 45 | 600 | 50 | INVENTION EXAMPLE |
| 62 | 900 | 45 | 600 | 50 | INVENTION EXAMPLE |
| 63 | 893 | 55 | 600 | 50 | COMPARATIVE EXAMPLE |
| 64 | 889 | 45 | 600 | 50 | INVENTION EXAMPLE |
| 65 | 917 | 45 | 600 | 50 | INVENTION EXAMPLE |
| 66 | 897 | 45 | 600 | 50 | INVENTION EXAMPLE |
| 67 | 891 | 45 | 600 | 50 | INVENTION EXAMPLE |
| 68 | 914 | 45 | 600 | 50 | INVENTION EXAMPLE |

TABLE 6-continued

| | | | | | |
|---|---|---|---|---|---|
| 69 | 903 | 45 | 600 | 50 | INVENTION EXAMPLE |
| 70 | 915 | 45 | 600 | 50 | INVENTION EXAMPLE |
| 71 | 908 | 45 | 600 | 50 | INVENTION EXAMPLE |
| 72 | 901 | 45 | 600 | 50 | INVENTION EXAMPLE |
| 73 | 930 | 45 | 600 | 50 | INVENTION EXAMPLE |

TABLE 7

| | | ANNEALING | | | | | |
|---|---|---|---|---|---|---|---|
| SAMPLE No. | MARK OF STEEL | TEMPERATURE INCREASING RATE (° C./s) | TEMPERATURE (° C.) | TIME (s) | FIRST AVERAGE COOLING RATE (° C./s) | FIRST COOLING STOP TEMPERATURE (° C.) | SECOND AVERAGE COOLING RATE (° C./s) |
| 41 | A2 | 2 | 950 | 100 | 2.0 | 600 | 40 |
| 42 | B2 | 2 | 950 | 100 | 2.0 | 700 | 40 |
| 43 | C2 | 10 | 950 | 100 | 2.0 | 720 | 40 |
| 44 | C2 | 10 | 900 | 100 | 2.0 | 720 | 40 |
| 45 | C2 | 13 | 920 | 100 | 2.0 | 750 | 40 |
| 46 | C2 | 5 | 790 | 100 | 2.0 | 600 | 40 |
| 47 | C2 | | | HOT ROLLING IMPOSSIBLE | | | |
| 48 | C2 | 10 | 950 | 100 | 3.5 | 720 | 40 |
| 49 | C2 | 2 | 950 | 100 | 2.3 | 700 | 40 |
| 50 | C2 | 10 | 950 | 100 | 2.3 | 700 | 40 |
| 51 | D2 | 10 | 900 | 100 | 2.0 | 700 | 40 |
| 52 | E2 | 2 | 1000 | 100 | 1.5 | 780 | 40 |
| 53 | F2 | 2 | 950 | 100 | 2.0 | 650 | 40 |
| 54 | G2 | 2 | 980 | 100 | 2.0 | 780 | 40 |
| 55 | H2 | 5 | 1050 | 100 | 3.5 | 730 | 40 |
| 56 | H2 | 2 | 920 | 100 | 2.0 | 700 | 40 |
| 57 | H2 | 10 | 880 | 100 | 2.0 | 680 | 40 |
| 58 | I2 | 2 | 950 | 100 | 2.0 | 700 | 40 |
| 59 | J2 | 2 | 920 | 100 | 2.0 | 700 | 40 |
| 60 | K2 | 2 | 950 | 100 | 2.0 | 700 | 40 |
| 61 | L2 | 2 | 950 | 100 | 2.0 | 700 | 40 |
| 62 | M2 | 2 | 920 | 100 | 2.0 | 680 | 40 |
| 63 | N2 | 5 | 930 | 100 | 2.0 | 700 | 40 |
| 64 | N2 | 2 | 900 | 100 | 2.0 | 680 | 40 |
| 65 | O2 | 2 | 900 | 100 | 2.0 | 680 | 40 |
| 66 | P2 | 2 | 900 | 100 | 2.0 | 680 | 40 |
| 67 | Q2 | 2 | 920 | 100 | 2.0 | 680 | 40 |
| 68 | R2 | 2 | 920 | 100 | 2.0 | 680 | 40 |
| 69 | S2 | 2 | 950 | 100 | 2.0 | 700 | 40 |
| 70 | T2 | 2 | 950 | 100 | 1.2 | 650 | 40 |
| 71 | U2 | 2 | 950 | 100 | 1.6 | 650 | 40 |
| 72 | V2 | 2 | 980 | 100 | 2.0 | 700 | 40 |
| 73 | W2 | 2 | 1050 | 100 | 2.0 | 750 | 40 |

| | ANNEALING | | | | | |
|---|---|---|---|---|---|---|
| SAMPLE No. | SECOND COOLING STOP TEMPERATURE (° C.) | HOLDING TEMPERATURE (° C.) | HOLDING TIME (s) | $Ac_1$ (° C.) | $Ac_3$ (° C.) | REMARK |
| 41 | 350 | 350 | 300 | 760 | 969 | COMPARATIVE EXAMPLE |
| 42 | 350 | 350 | 300 | 762 | 950 | INVENTION EXAMPLE |
| 43 | 250 | 350 | 300 | 787 | 971 | INVENTION EXAMPLE |
| 44 | 400 | 400 | 300 | 787 | 971 | COMPARATIVE EXAMPLE |
| 45 | 400 | 400 | 300 | 787 | 971 | COMPARATIVE EXAMPLE |
| 46 | 250 | 350 | 300 | 787 | 971 | COMPARATIVE EXAMPLE |
| 47 | | HOT ROLLING IMPOSSIBLE | | 787 | 971 | COMPARATIVE EXAMPLE |
| 48 | 300 | 400 | 300 | 787 | 971 | COMPARATIVE EXAMPLE |
| 49 | 250 | 300 | 300 | 787 | 971 | INVENTION EXAMPLE |
| 50 | 250 | 400 | 300 | 787 | 971 | COMPARATIVE EXAMPLE |
| 51 | 250 | 400 | 300 | 705 | 848 | COMPARATIVE EXAMPLE |
| 52 | 250 | 300 | 300 | 859 | 1104 | COMPARATIVE EXAMPLE |
| 53 | 300 | 350 | 300 | 772 | 944 | COMPARATIVE EXAMPLE |
| 54 | 180 | 280 | 300 | 816 | 1004 | INVENTION EXAMPLE |
| 55 | 250 | 300 | 300 | 772 | 940 | COMPARATIVE EXAMPLE |
| 56 | 250 | 300 | 300 | 772 | 940 | INVENTION EXAMPLE |
| 57 | 250 | 350 | 300 | 772 | 940 | COMPARATIVE EXAMPLE |
| 58 | 250 | 300 | 300 | 786 | 956 | INVENTION EXAMPLE |
| 59 | 250 | 300 | 300 | 770 | 929 | INVENTION EXAMPLE |
| 60 | 250 | 300 | 300 | 791 | 949 | INVENTION EXAMPLE |
| 61 | 250 | 300 | 300 | 786 | 965 | INVENTION EXAMPLE |
| 62 | 260 | 300 | 300 | 775 | 940 | INVENTION EXAMPLE |

TABLE 7-continued

| | | | | | | |
|---|---|---|---|---|---|---|
| 63 | 350 | 350 | 300 | 770 | 934 | COMPARATIVE EXAMPLE |
| 64 | 260 | 300 | 300 | 770 | 934 | INVENTION EXAMPLE |
| 65 | 260 | 300 | 300 | 772 | 924 | INVENTION EXAMPLE |
| 66 | 260 | 300 | 300 | 770 | 924 | INVENTION EXAMPLE |
| 67 | 260 | 300 | 300 | 783 | 949 | INVENTION EXAMPLE |
| 68 | 260 | 300 | 300 | 780 | 949 | INVENTION EXAMPLE |
| 69 | 250 | 320 | 250 | 765 | 934 | INVENTION EXAMPLE |
| 70 | 250 | 320 | 300 | 693 | 909 | INVENTION EXAMPLE |
| 71 | 250 | 300 | 300 | 712.6 | 916 | INVENTION EXAMPLE |
| 72 | 230 | 250 | 300 | 765.8 | 968 | INVENTION EXAMPLE |
| 73 | 220 | 300 | 300 | 845.6 | 1024 | INVENTION EXAMPLE |

Then, steel microstructures of the obtained cold-rolled steel sheets were observed. In the observation of each of the steel microstructures, by the above-described method, an area ratio of ferrite, an area ratio of a hard microstructure (a total area ratio of bainite, martensite, tempered martensite and retained austenite), a total area ratio of pearlite and carbide, and a standard deviation of a line fraction of the hard microstructure were measured. Table 8 presents these results. Underlines in Table 8 indicate that numerical values thereon deviate from a range of the present invention.

Moreover, a tensile strength TS, a fracture elongation EL, and a hole expansion ratio HER of each of the obtained cold-rolled steel sheets were measured. In the measurement of the tensile strength TS and the fracture elongation EL, a JIS No. 5 tensile test piece in which a direction orthogonal to a rolling direction was set as a longitudinal direction was picked, and a tensile test was performed in conformity to JIS Z 2241. In the measurement of the hole expansion ratio HER, from each of the cold-rolled steel sheets, a 90 mm square test piece was picked, a hole expansion test conforming to the standard of JIS Z 2256 (or JIS T 1001) was performed. At this time, a hole expansion test rate was set to 1 mm/sec. Table 8 also presents these results. Underlines in Table 8 indicate that numerical values thereon deviate from desirable ranges. The desirable ranges mentioned here mean that the tensile strength TS is 780 MPa or more, the fracture elongation EL is 10% or more, and the hole expansion ratio HER is 30% or more.

In addition, an appearance inspection at a time of molding was performed in a visual manner. The appearance inspection was performed by the following method. First, each of the steel sheets was cut into 40 mm in width×100 mm in length, and was obtained as a test piece by polishing its surface until metallic luster was able to be seen. The test piece was subjected to a 90-degree V-bending test at two levels in which a ratio (R/t) between a sheet thickness t and a bend radius R was 2.0 and 2.5 under a condition in which a bending edge line became a rolling direction. After the test, a surface property of a bent portion was observed in a visual manner. A case where an uneven appearance or a crack was recognized on a surface in a test in which the ratio (R/t) was 2.5 was judged poor. A case where an uneven appearance and a crack were not recognized in the test in which the ratio (R/t) was 2.5 but an uneven appearance or a crack was recognized on a surface in a test in which the ratio (R/t) was 2.0 was judged good. A case where an uneven appearance and a crack were not recognized on a surface in either of the test in which the ratio (R/t) was 2.5 and the test in which the ratio (R/t) was 2.0 was judged excellent. Table 8 also presents this result.

TABLE 8

| SAMPLE No. | MARK OF STEEL | STEEL MICROSTRUCTURE: AREA RATIO OF FERRITE (%) | AREA RATIO OF HARD MICROSTRUCTURE (%) | AREA RATIO OF RETAINED γ (%) | TOTAL AREA RATIO OF PEARLITE AND CARBIDE (%) | STANDARD DEVIATION (%) | MECHANICAL PROPERTY: TS (MPa) | EL (%) | HER (%) | TS* HER (MPa · %) | APPEARANCE | REMARK |
|---|---|---|---|---|---|---|---|---|---|---|---|---|
| 41 | A2 | 91.6 | 8.1 | 1.6 | 0.3 | 0.0328 | 441 | 23.6 | 62.3 | 27474 | EXCELLENT | COMPARATIVE EXAMPLE |
| 42 | B2 | 26.1 | 72.0 | 17.5 | 1.9 | 0.0496 | 1049 | 15.3 | 45.1 | 47310 | EXCELLENT | INVENTION EXAMPLE |
| 43 | C2 | 32.1 | 65.9 | 16.4 | 2.0 | 0.0412 | 1199 | 14.2 | 43.2 | 51797 | EXCELLENT | INVENTION EXAMPLE |
| 44 | C2 | 33.5 | 66.3 | 18.3 | 0.2 | 0.0502 | 1215 | 15.3 | 29.5 | 35843 | POOR | COMPARATIVE EXAMPLE |
| 45 | C2 | 25.1 | 73.2 | 15.2 | 1.7 | 0.0581 | 1163 | 15.1 | 28.9 | 33611 | POOR | COMPARATIVE EXAMPLE |
| 46 | C2 | 80.9 | 14.3 | 5.1 | 4.8 | 0.0681 | 556 | 12.6 | 18.3 | 10175 | POOR | COMPARATIVE EXAMPLE |
| 47 | C2 | | | | MEASUREMENT IMPOSSIBLE | | | | | | | COMPARATIVE EXAMPLE |
| 48 | C2 | 29.3 | 69.6 | 5.6 | 1.1 | 0.0566 | 1022 | 12.3 | 26.3 | 26879 | POOR | COMPARATIVE EXAMPLE |
| 49 | C2 | 40.1 | 57.1 | 6.3 | 2.8 | 0.0422 | 1053 | 12.5 | 30.6 | 32222 | EXCELLENT | INVENTION EXAMPLE |
| 50 | C2 | 34.3 | 63.1 | 16.2 | 2.6 | 0.0531 | 1088 | 16.3 | 22.3 | 24262 | POOR | COMPARATIVE EXAMPLE |
| 51 | D2 | 13.8 | 84.6 | 15.8 | 1.6 | 0.0532 | 1399 | 12.6 | 21.3 | 29799 | POOR | COMPARATIVE EXAMPLE |
| 52 | E2 | 63.4 | 25.6 | 6.9 | 11.0 | 0.0695 | 988 | 12.3 | 29.3 | 28948 | POOR | COMPARATIVE EXAMPLE |
| 53 | F2 | 61.6 | 36.8 | 5.1 | 1.6 | 0.0468 | 765 | 14.9 | 36.3 | 27770 | EXCELLENT | COMPARATIVE EXAMPLE |
| 54 | G2 | 15.4 | 83.1 | 19.1 | 1.5 | 0.0491 | 1471 | 13.1 | 32.4 | 47660 | EXCELLENT | INVENTION EXAMPLE |
| 55 | H2 | 4.5 | 93.9 | 9.8 | 1.6 | 0.0399 | 1344 | 9.1 | 71.3 | 95827 | EXCELLENT | COMPARATIVE EXAMPLE |
| 56 | H2 | 30.1 | 68.5 | 15.5 | 1.4 | 0.0412 | 1136 | 13.5 | 35.5 | 40328 | EXCELLENT | INVENTION EXAMPLE |
| 57 | H2 | 37.4 | 61.2 | 17.9 | 1.4 | 0.0558 | 1241 | 14.8 | 19.3 | 23951 | POOR | COMPARATIVE EXAMPLE |
| 58 | I2 | 34.8 | 64.2 | 19.2 | 1.0 | 0.0425 | 1199 | 16.6 | 39.0 | 46761 | EXCELLENT | INVENTION EXAMPLE |
| 59 | J2 | 25.9 | 72.1 | 17.5 | 2.0 | 0.0403 | 1178 | 13.2 | 38.1 | 44882 | EXCELLENT | INVENTION EXAMPLE |
| 60 | K2 | 40.1 | 58.9 | 15.2 | 1.0 | 0.0442 | 1111 | 23.5 | 40.4 | 44884 | EXCELLENT | INVENTION EXAMPLE |
| 61 | L2 | 37.1 | 62.3 | 15.3 | 0.6 | 0.0407 | 1099 | 15.5 | 43.2 | 47477 | EXCELLENT | INVENTION EXAMPLE |
| 62 | M2 | 43.1 | 55.9 | 13.7 | 1.0 | 0.0412 | 1022 | 15.9 | 41.3 | 42209 | EXCELLENT | INVENTION EXAMPLE |
| 63 | N2 | 32.5 | 66.5 | 17.9 | 1.0 | 0.0534 | 1192 | 14.5 | 25.6 | 30515 | POOR | COMPARATIVE EXAMPLE |
| 64 | N2 | 32.1 | 66.4 | 15.9 | 0.8 | 0.0399 | 1127 | 15.2 | 46.8 | 52744 | EXCELLENT | INVENTION EXAMPLE |
| 65 | O2 | 30.1 | 69.3 | 15.4 | 0.6 | 0.0432 | 1183 | 13.6 | 37.8 | 44717 | EXCELLENT | INVENTION EXAMPLE |
| 66 | P2 | 29.2 | 69.3 | 16.3 | 1.5 | 0.0468 | 1149 | 13.8 | 36.2 | 41594 | EXCELLENT | INVENTION EXAMPLE |
| 67 | Q2 | 46.4 | 53.2 | 12.0 | 0.4 | 0.0472 | 983 | 14.9 | 43.2 | 42466 | EXCELLENT | INVENTION EXAMPLE |
| 68 | R2 | 45.2 | 53.5 | 14.2 | 1.3 | 0.0398 | 1001 | 16.2 | 40.1 | 40140 | EXCELLENT | INVENTION EXAMPLE |
| 69 | S2 | 26.9 | 72.2 | 4.8 | 0.9 | 0.0476 | 1260 | 11.3 | 35.1 | 44217 | EXCELLENT | INVENTION EXAMPLE |
| 70 | T2 | 22.3 | 77.1 | 22.6 | 0.6 | 0.0478 | 1589 | 15.9 | 30.1 | 47829 | EXCELLENT | INVENTION EXAMPLE |
| 71 | U2 | 28.3 | 71.2 | 17.8 | 0.5 | 0.0444 | 1399 | 14.8 | 35.2 | 49245 | EXCELLENT | INVENTION EXAMPLE |
| 72 | V2 | 62.2 | 37.3 | 8.9 | 0.5 | 0.0397 | 791 | 17.8 | 51.0 | 40341 | EXCELLENT | INVENTION EXAMPLE |
| 73 | W2 | 54.2 | 45.7 | 12.3 | 0.1 | 0.0391 | 1567 | 18.6 | 30.9 | 48420 | EXCELLENT | INVENTION EXAMPLE |

As presented in Table 8, in each of samples No. 42, No. 43, No. 49, No. 54, No. 56, No. 58 to No. 62, and No. 64 to No. 72 which were in a range of the present invention, it was possible to obtain excellent tensile strength, fracture elongation and hole expandability. Among these, in each of samples No. 58 and so on, since an area ratio of retained austenite (retained γ) was 5.0% or more, fracture elongation more excellent than that in a sample No. 69 was obtained. Moreover, as compared with the invention examples of the first examples, values of TS×HER were larger. This indicates that higher tensile strength is obtained while securing excellent hole expandability. As one of the reasons why the values of TS×HER are larger in the invention examples of the second examples than those in the invention examples of the first examples, a higher Si content can be cited.

On the other hand, in a sample No. 41, since the C content was too low, an area ratio of ferrite was too high, and an area ratio of a hard microstructure was too low, tensile strength was low. In a sample No. 51, since the Si content was too low and a standard deviation of a line fraction of a hard microstructure was too large, a hole expansion ratio was low. In a sample No. 52, since the Si content was too high and a standard deviation of a line fraction of a hard microstructure was too large, a hole expansion ratio was low. In a sample No. 53, since the Mn content was too low, tensile strength was low.

In each of samples No. 44, No. 45, No. 48, No. 50, No. 57, and No. 63, since a standard deviation of a line fraction of a hard microstructure was too large, a hole expansion ratio was low. In a sample No. 46, since an area ratio of ferrite was too high, an area ratio of a hard microstructure was too low, and a standard deviation of a line fraction of the hard microstructure was too large, tensile strength and a hole expansion ratio were low. In a sample No. 47, since a deformation ratio in a thickness direction in the multi-axial compression forming was too low, hot rolling was not able to be performed thereafter. In a sample No. 55, since an area ratio of ferrite was too low and an area ratio of a hard microstructure was too high, fracture elongation was low.

INDUSTRIAL APPLICABILITY

The present invention can be utilized in, for example, an industry related to a steel sheet suitable for automotive parts.

The invention claimed is:

1. A steel sheet comprising:

a chemical composition represented by, in mass %,

C: 0.05% to 0.40%,

Si: 2.6% to 6.00%,

Mn: 1.50% to 10.00%,

Acid-soluble Al: 0.01% to 1.00%,

P: 0.10% or less,

S: 0.01% or less,

N: 0.01% or less,

Ti: 0.0% to 0.2%,

Nb: 0.0% to 0.2%,

V: 0.0% to 0.2%,

Cr: 0.0% to 1.0%,

Mo: 0.0% to 1.0%,

Cu: 0.0% to 1.0%,

Ni: 0.0% to 1.0%,

Ca: 0.00% to 0.01%,

Mg: 0.00% to 0.01%,

REM: 0.00% to 0.01%,

Zr: 0.00% to 0.01%, and the balance: Fe and impurities, and comprising a steel microstructure represented by, in an area ratio, ferrite: 5% to 80%, a hard microstructure constituted of bainite, martensite or retained austenite or an arbitrary combination of the above: 20% to 95%, wherein at least 5% is retained austenite, and a standard deviation of a line fraction of the hard microstructure on a line in a plane perpendicular to a thickness direction: 0.050 or less in a depth range where a depth from a surface when a thickness of a steel sheet is set as t is from 3t/8 to t/2.

2. The steel sheet according to claim 1, wherein in the chemical composition, in mass %, Ti: 0.003% to 0.2%, Nb: 0.003% to 0.2%, or V: 0.003% to 0.2%, or an arbitrary combination of the above is established.

3. The steel sheet according to claim 1, in the chemical composition, in mass %, Cr: 0.005% to 1.0%, Mo: 0.005% to 1.0%, Cu: 0.005% to 1.0%, or Ni: 0.005% to 1.0%, or an arbitrary combination of the above is established.

4. The steel sheet according to claim 1, wherein in the chemical composition, in mass %, Ca: 0.0003% to 0.01%, Mg: 0.0003% to 0.01%, REM: 0.0003% to 0.01%, or Zr: 0.0003% to 0.01%, or an arbitrary combination of the above is established.

* * * * *